US010710692B1

(12) United States Patent
Wittich

(10) Patent No.: US 10,710,692 B1
(45) Date of Patent: Jul. 14, 2020

(54) BOAT OUTBOARD MOTOR PROTECTION DEVICE

(71) Applicant: KT MARINE SERVICES, LLC, Covington, LA (US)

(72) Inventor: Kort Wittich, Covington, LA (US)

(73) Assignee: KT MARINE SERVICES, LLC, Covington, LA (US)

( * ) Notice: Subject to any disclaimer, the term of this patent is extended or adjusted under 35 U.S.C. 154(b) by 0 days.

(21) Appl. No.: 15/942,851

(22) Filed: Apr. 2, 2018

Related U.S. Application Data

(60) Provisional application No. 62/628,497, filed on Feb. 9, 2018, provisional application No. 62/480,043, filed on Mar. 31, 2017.

(51) Int. Cl.
*B63H 20/36* (2006.01)

(52) U.S. Cl.
CPC ..... *B63H 20/36* (2013.01)

(58) Field of Classification Search
CPC ..... B63H 20/36; B63B 2017/0045
USPC ..... 114/361, 219; 441/108, 119, 125; 440/76, 77
See application file for complete search history.

(56) References Cited

U.S. PATENT DOCUMENTS 2,331,420 A 10/1943 Rando
2,887,563 A 5/1959 Kiekhaefer
3,870,875 A 3/1975 Altimus
4,498,875 A 2/1985 Watanabe
4,822,309 A * 4/1989 Vandenberg ..... A45C 9/00 297/188.01
4,843,994 A 7/1989 Wilson et al.
4,891,848 A * 1/1990 Carter ..... A47K 3/125 4/571.1
5,000,710 A * 3/1991 Bedortha ..... A63B 21/00047 441/113
5,048,446 A 9/1991 Powell
D375,924 S * 11/1996 Kramer ..... D12/133
5,701,837 A 12/1997 Harvey
5,785,568 A * 7/1998 Lake ..... B63C 9/28 441/115
6,339,661 B1 1/2002 Kokkelink et al.
7,159,526 B2 1/2007 Derochers
7,163,428 B2 1/2007 Sanschagrin
7,736,207 B2 6/2010 Vignau
8,156,883 B2 4/2012 Sheedy et al.
8,257,121 B2 9/2012 Taylor
9,027,495 B2 5/2015 Marshall
9,924,779 B1 * 3/2018 Parsons ..... A45F 5/021
2015/0076194 A1 * 3/2015 Sidwa ..... B63B 35/7946 224/259

(Continued)

*Primary Examiner* — Anthony D Wiest
(74) *Attorney, Agent, or Firm* — Garvey, Smith & Nehrbass, Patent Attorneys, L.L.C.; Vanessa M. D'Souza; Charles C. Garvey, Jr.

(57) ABSTRACT

The present invention relates to an apparatus and method of protecting a boat motor powerhead or cowl or cowling and preventing damage to the powerhead, cowl or cowling when a boat is docking or backing into a bulk head. More particularly, the present invention relates to a protective device that easily attaches to and slips over the boat motor, allowing for easy positioning of a protective pad on the outside of the motor which protects it from impact and prevents damage to the motor while the boat is docking or backing into a bulk head.

20 Claims, 21 Drawing Sheets

(56) References Cited

U.S. PATENT DOCUMENTS

2016/0286939 A1* 10/2016 Spears ..... A45C 13/30

* cited by examiner

BOAT OUTBOARD MOTOR PROTECTION DEVICE

CROSS-REFERENCE TO RELATED APPLICATIONS

This application claims benefit of U.S. Provisional Patent Application Ser. No. 62/480,043, filed 31 Mar. 2017; and U.S. Provisional Patent Application Ser. No. 62/628,497, filed 9 Feb. 2018, each of which is hereby incorporated herein by reference.

Priority of U.S. Provisional Patent Application Ser. No. 62/480,043, filed 31 Mar. 2017; and U.S. Provisional Patent Application Ser. No. 62/628,497, filed 9 Feb. 2018, each of which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an apparatus and method of protecting an outboard boat motor and preventing damage to the motor power head or cowl or cowling when a boat is docking or backing into a bulk head. More particularly, the present invention relates to a cover or protective pad that can easily attach to and slip/slide over the boat motor, allowing for easy positioning of a protective cover on the outside of the motor, and which protects the motor from impact and prevents damage to the motor while the boat is docking or backing into a bulk head.

2. General Background of the Invention

The present invention relates to an apparatus and method of protecting a boat motor, such as a outboard motor, and preventing damage to the power head or cowl/cowling when a boat is docking or backing into a bulk head. More particularly, the present invention relates to a cover or protective pad that can easily attach to and slip over the boat motor, allowing for easy positioning of a protective cover on the outside of the motor which protects it from impact and prevents damage to the motor while the boat is docking or backing into a bulk head.

When a boat docks, the motor engine frequently bumps into the dock, which damages, scrapes, and/or cracks the motor. This repeated damage ultimately affects the durability of the motor, forcing the boat owner to buy a new motor, which can be expensive.

The following US Patents are hereby incorporated herein by reference:

| Pat. No. | TITLE | ISSUE DATE |
|---|---|---|
| 2,331,420 | Boat Bumper | 12 Oct. 1943 |
| 2,887,563 | Stern light mounting for outboard motors | 19 May 1959 |
| 3,870,875 | Inboard Outboard Motor Cover | 11 Mar. 1975 |

-continued

| Pat. No. | TITLE | ISSUE DATE |
|---|---|---|
| 4,498,875 | Outboard motor | 12 Feb. 1985 |
| 4,843,994 | Boat Fender Cover and Hanger Assembly | 4 Jul. 1989 |
| 5,048,446 | Harness for Securing a Fender to a Boat | 17 Sept. 1991 |
| 5,701,837 | Boat Dock Bumper | 30 Dec. 1997 |
| 6,339,661 | Boat Dock Bumper | 26 Feb. 2002 |
| 7,159,526 | Retractable Bumper System and Method | 9 Jan. 2007 |
| 7,163,428 | Outboard Engine Cowling | 16 Jan. 2007 |
| 7,736,207 | Marine outboard engine having a padded section | 15 Jun. 2010 |
| 8,156,883 | Boat Bumper Assembly | 17 Apr. 2012 |
| 8,257,121 | Boat Propeller Shield | 4 Sept. 2012 |
| 9,027,495 | Boat Protection Device | 12 May 2015 |
| D375,924 | Boat Fender Strap | 26 Nov. 1996 |

BRIEF SUMMARY OF THE INVENTION

The present invention relates to an apparatus and method of protecting a boat motor and preventing damage to the motor powerhead or cowl or cowling when a boat is docking or backing into a bulk head. More particularly, the present invention relates to a protective pad or cover that can easily attach to and slip over the boat motor, allowing for easy positioning of a protective pad or cover on the outside rear portion of the motor which protects the motor from impact and prevents damage to the motor while the boat is docking or backing into a bulk head.

The apparatus of the present invention includes a protective pad attached to a securing device that can easily be placed over or around a boat motor.

In one embodiment of the apparatus of the present invention, the protective pad body includes an insert preferably made of a heavy-duty foam encased in a cloth material with a removeable strap(s) that can be sized to fit around the cowl or cowling of a majority of outboard boat motors that are commercially available. The protective pad is preferably sized and shaped to cover a substantial portion of the rear of the motor cowl or cowling and fit at the rear of the power head, between the motor and the dock. The lower end of the protective pad can extend below a lower edge of the motor cowl.

In one embodiment, the present invention can be fully adjustable to fit a wide variety of outboard boat engines to protect a fiberglass cowl, cowling, or shroud and painted surfaces from abrasion and damage when docking the aft first to docks and other stationary moorings. In one embodiment, the present invention can be easily placed onto a motor and can be easily taken off the motor. In one embodiment, once the present invention is adjusted to fit the size of shape of an engine, it preferably does not have to be adjusted again, so once removal of the present invention from an engine has occurred, putting it back on the same engine can be easily accomplished by simply pressing the suction pad(s) in place and sliding the present invention back over the rear of the engine. In one embodiment, the present invention is sized and shaped to be easily stored on the boat when not in use.

In one embodiment, the present invention includes a protective pad sized and shaped to cover a substantial portion of the rear surface of a boat motor cowl or cowling and an adjustable securing device attached to the protective pad that can be easily placed and secured around a boat motor cowl or cowling.

In one embodiment, the present invention includes a protective pad comprised of a foam piece insert encased in an outer shell. Preferably, the protective pad includes at least two layers of foam. Preferably, at least one layer of foam is 4# XL PE Black. Preferably, at least one layer of foam is 4# Ether Charcoal. Preferably, the at least two layers of foam are bonded together with industrial upholstery glue.

In one embodiment, the protective pad can be an elongate shape. In one embodiment, the pad portion can be generally rectangular. In one embodiment the pad portion can have a flap or tab on each side. Preferably, the middle section of the elongate protective pad is wider than the top and bottom sections of the protective pad. Preferably, the protective pad is about 23.5 inches (59.7 cm) in height, about 9 inches (22.9 cm) wide at the top and bottom portions, and about 17.5 inches (44.5 cm) wide in the middle section. More preferably, the protective pad includes a wing-like middle section that is about 7 inches (17.8 cm) in height, and is located about 8 inches (20.3 cm) from the bottom of the protective pad.

In one embodiment, the present invention includes a protective pad that can be attached to the outboard engine using straps that wrap around the engine. Preferably, the elastic straps are at least about 3 inches (7.6 cm) wide. Preferably, the straps can be elastic.

In one embodiment, the present invention includes a securing device comprised of an adjustable sling rope.

In one embodiment, the present invention includes a securing device further comprised of a suction cup connected to the adjustable sling rope.

In one embodiment, the present invention includes a securing device comprised of a plurality of straps that connect to each other.

In one embodiment, the present invention includes a securing device comprised of straps that connect to each other with a hook and loop attachment, such as Velcro®.

In one embodiment, the present invention includes a protective pad that has at least one suction cup on the inner surface to enable attachment to the boat motor.

In one embodiment, the present invention includes a method of protecting the exterior of a boat motor powerhead, cowl or cowling, particularly when a boat is docking or backing into a bulk head, using the apparatus of the present invention.

The present invention includes a boat motor protection device, including a pad sized and shaped to cover a substantial portion of the rear surface of a boat motor cowling, and an adjustable securing device attached to the protective pad that can be easily placed and secured around a boat motor cowling.

In one embodiment, the protective pad can be comprised of an insert that can be made of a foam piece and encased in an outer shell.

In one embodiment, the securing device can be comprised of an adjustable sling rope.

In one embodiment, the securing device can further comprise one or more suction cups connected to the adjustable sling rope.

In one embodiment, the securing device can be comprised of a plurality of straps that connect to each other.

In one embodiment, the straps can connect to each other with a hook and loop attachment.

In one embodiment, the straps can have one or more suction pads on the inner surface to enable attachment to the boat motor.

In one embodiment, the hook and loop attachment can be Velcro® brand.

In one embodiment, the protective pad can have one or more suction pads on the inner surface to enable attachment to the boat motor.

The present invention includes a method of protecting the exterior of a boat motor.

The present invention includes boat motor protection device including a pad sized and shaped to cover a substantial portion of the rear surface of a boat motor cowling, an adjustable securing device, and means for attaching the securing device to the boat, wherein the boat motor cover can be secured to the boat by the securing device and means for attaching the securing device to the boat such that the protective pad can be easily placed and secured around a boat motor.

The present invention includes an outboard boat motor protection device having a protective pad that can be sized and shaped to cover a substantial portion of the rear surface of an outboard boat motor cowling having a lower edge. A strap can be attached to the protective pad that can be sized and shaped to extend around the cowling. The strap can be positioned in a securement position above the lower edge of the cowling.

In various embodiments, the protective pad can be comprised of a foam piece encased in an outer shell.

In various embodiments, the strap can be comprised of a plurality of straps that can connect to each other.

In various embodiments, the plurality of straps can connect to each other with a hook and loop attachment.

In various embodiments, the hook and loop attachment can be Velcro® brand.

In various embodiments, the protective pad can have one or more suction pads on the inner surface to enable attachment to the boat motor.

The present invention includes a method of protecting the exterior of an outboard boat motor cowling using the apparatus disclosed in this application.

The present invention includes a method of protecting the exterior of an outboard boat motor cowling by the following steps: a) placing the protective pad at a rear portion of the motor requiring protection; b) securing the protective pad with one or more straps; and c) the one or more straps can be positioned above the lower edge of the cowling.

In various embodiments, at least one of the plurality of straps can further include a suction device for securing the plurality of straps to the motor.

The present invention includes an outboard boat motor protection device having a protective pad that can be sized and shaped to cover a substantial portion of the rear surface of an outboard boat motor cowling having a bottom edge, an adjustable securing device that can be attached to the pad, a means for attaching the securing device to the boat, and the means can extend above the bottom edge of the cowling, wherein the boat motor protection device can be secured to the boat by the securing device and means for attaching the securing device to the boat such that the protective pad can be easily placed and secured around a boat motor.

In various embodiments, the protective pad can comprised of a foam insert encased in an outer shell.

In various embodiments, the securing device can be comprised of an adjustable sling rope.

In various embodiments, the securing device can further comprise a suction cup connected to the adjustable sling rope.

In various embodiments, the securing device can be comprised of a plurality of straps that connect to each other.

In various embodiments, the straps can connect to each other with a hook and loop attachment.

In various embodiments, the hook and loop attachment can be Velcro® brand.

In various embodiments, the protective pad can have a suction pad on the inner surface to enable attachment to the boat motor.

The present invention includes a method of protecting the exterior of one or more boat motors using one or more of the apparatus as disclosed in this application.

The present invention includes an outboard boat motor protection device having a protective pad that can be sized and shaped to cover a substantial portion of the rear surface of an outboard boat motor cowling having a cowling lower edge, an adjustable securing device that can be attached to the pad, wherein the pad can have a pad thickness that can be greater than the thickness of the securing device, wherein the boat motor protection device can be secured to the boat motor encircling the securing device and pad around the cowling such that the protective pad can be easily placed and secured around a boat motor.

In various embodiments, the protective pad can be comprised of a foam piece encased in an outer shell.

In various embodiments, the securing device can be comprised of two complementary straps, wherein the straps can be capable of being fastened to one another securing the boat motor protection device around the boat motor.

In various embodiments, the securing device further comprises a means for attaching the securing device to the boat motor.

In various embodiments, the means for attaching the securing device to the boat motor can be a suction device.

In various embodiments, the straps can connect to each other with a hook and loop attachment.

In various embodiments, the suction device can comprises at least 6 suction cups.

In various embodiments, the straps can be removably attached to the protective pad.

In various embodiments, the straps can have a female clip that corresponds to a male clip on the protective pad allowing for easy removal and attachment of the straps to the protective pad.

In various embodiments, the straps can be removed and replaced with an adapter, the adapter having a female clip that corresponds to the male clips on the protective pad, and an eyelet, wherein the adapter can be attached to a side of a boat via a rope attached to the eyelet, allowing the protective pad to be used as a boat side protection device.

The present invention includes a method of protecting a side of a boat using the protection device as disclosed herein.

In various embodiments, the pad can extend above and below the strap.

In various embodiments, the cowling can have cowling side portions and the pad extends to one or both of the side portions.

The present invention includes an outboard boat motor protection device having a pad that can be sized and shaped to cover a substantial portion of the rear surface of an outboard boat motor cowling having a cowling lower edge, the pad having an upper end section having a width, a lower end section having a width, a middle section having a width greater than the widths of the upper and lower ends, and side end portions. A strap can be attached to pad at the middle section and side end portions.

In various embodiments, the pad can be generally rectangular and can have laterally extending tabs provided on the middle section.

In various embodiments, the strap can attach to the laterally extending tabs.

In various embodiments, the pad can extend below the cowling lower edge.

In various embodiments, the strap can be positioned above the cowling lower edge.

In various embodiments, the strap further can comprise two straps attached to each other.

In various embodiments, the strap can have one or more suction cups attached for securing the strap to the cowling.

In various embodiments, the two straps can be attached with one or more fasteners.

In various embodiments, the fasteners can be hook and loop fasteners.

In various embodiments, the present invention can further comprise a first connector on each end portion of the strap and a second connector on each laterally extending tab of the pad, and wherein the strap is connected to the pad by attachment of the first and second connectors.

In various embodiments, the first connector can be a male clip.

In various embodiments, the second connector can be a female clip.

In various embodiments, the pad can comprise an inner insert and an outer shell.

In various embodiments, the present invention further comprises a sleeve on each laterally extending tab.

In various embodiments, the second connector can be enclosed within a sleeve provided on each laterally extending tab.

In various embodiments, the pad can comprise an inner insert, an outer shell, an interior strap provided inside the outer shell that connects one of the second connectors on one the pad side to the other of the second connectors on the other pad side.

In various embodiments, the inner insert can be made of layered foam.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
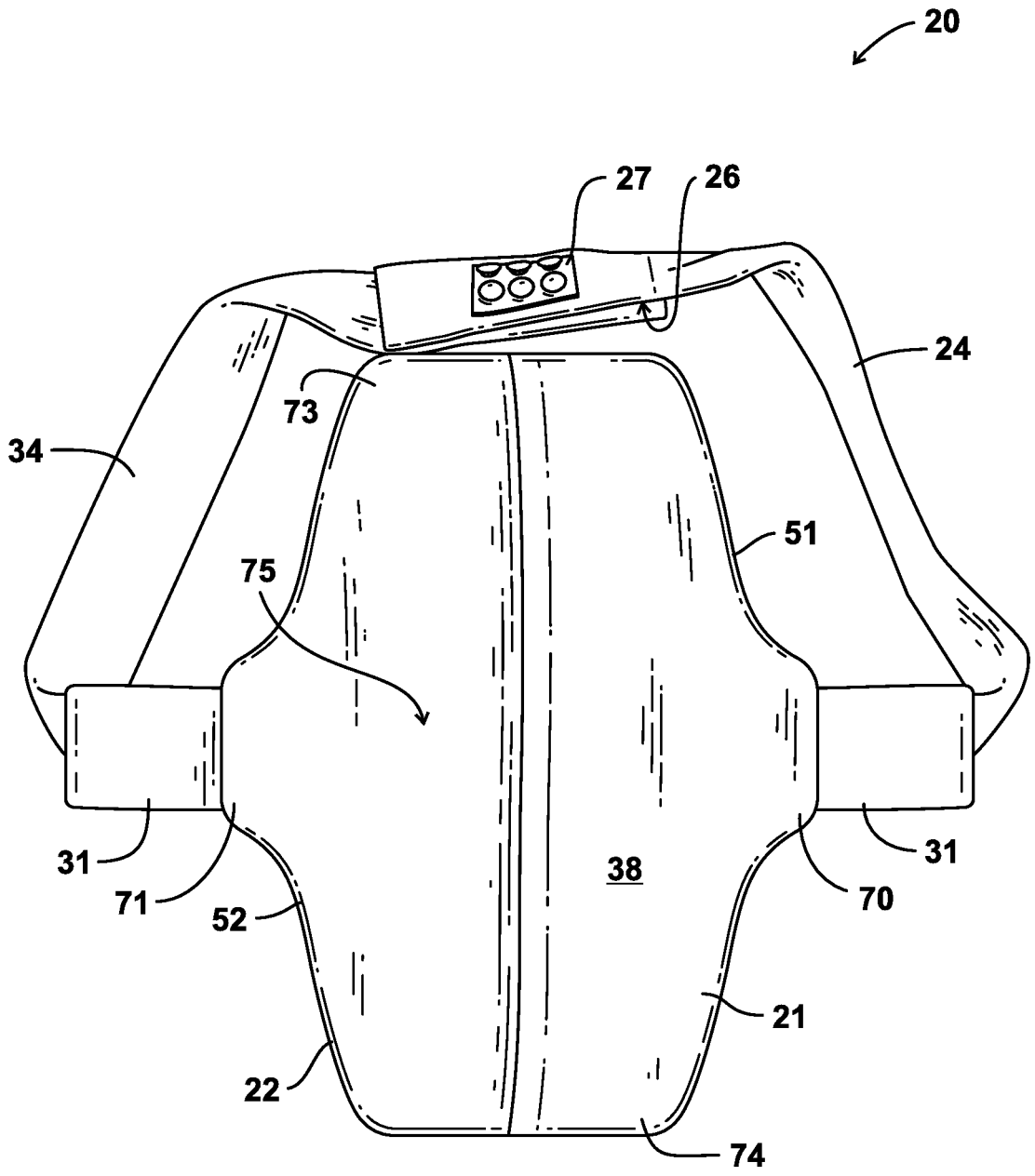
FIG. 1 is a rear perspective view of a preferred embodiment of the apparatus of the present invention.

FIGS. 1-25 show views of a preferred embodiment of the apparatus of the present invention, designated generally by the number 20. The present invention relates to an apparatus and method of protecting a boat motor 30 and preventing damage to the motor powerhead or cowl/cowling 65 when a boat 60 is docking or backing into a bulk head or dock 60. Motor 30 (see FIGS. 18, 19) can be an outboard type motor marketed under the marks Yamaha®, Mercury®, Johnson®, and Evinrude® as examples. Such motors 30 typically provide powerhead or upper covered with a cowl, cowling or shroud 65 and a lower or lower end 66 that includes a propeller 67. Such a motor with powerhead, cowling, lower unit and propeller can be seen in U.S. Pat. Nos. 2,887,563; 4,498,875; 7,163,428; 7,736,207, each of which is hereby incorporated herein by reference.

More particularly, the present invention relates to a cover 20 that can easily attach to and slip/slide over the boat motor 30, preferably allowing for easy positioning of a protective pad 21 on the outside of the motor 30. Motor engine 30 can have an upper portion or powerhead or cowl/cowling 65 and a lower portion 66 including a propeller 67. Upper portion or cowl/cowling 65 can have a lower edge 72. Pad portion 21 can protect motor 30 powerhead or cowl/cowling 65 from impact and prevents damage to the motor 30 powerhead or cowl or cowling 65 while a boat 60 is docking or backing into a bulk head.

Figure 2:
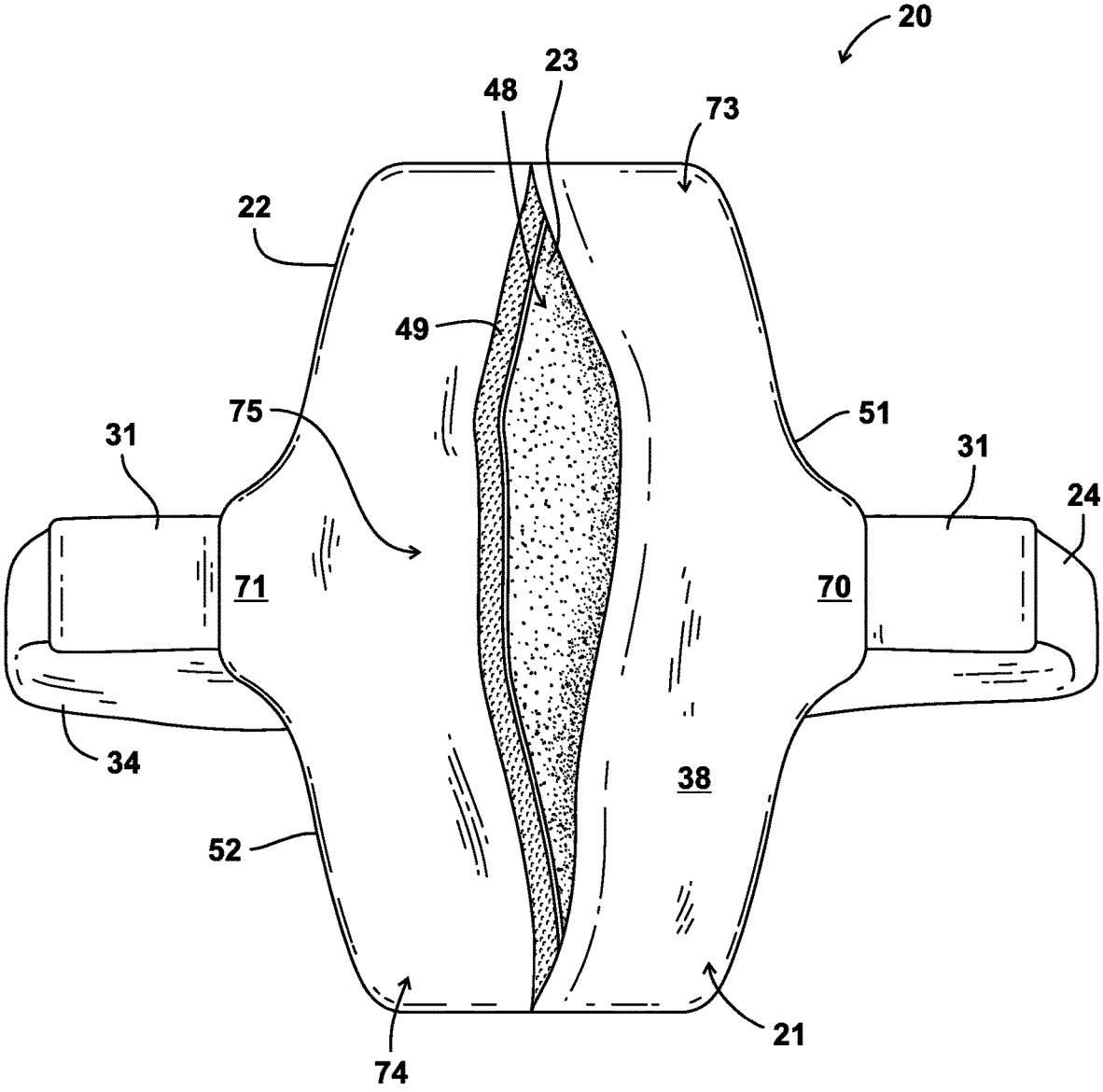
FIG. 2 is a rear perspective view of a preferred embodiment of the apparatus of the present invention.
Figure 3:
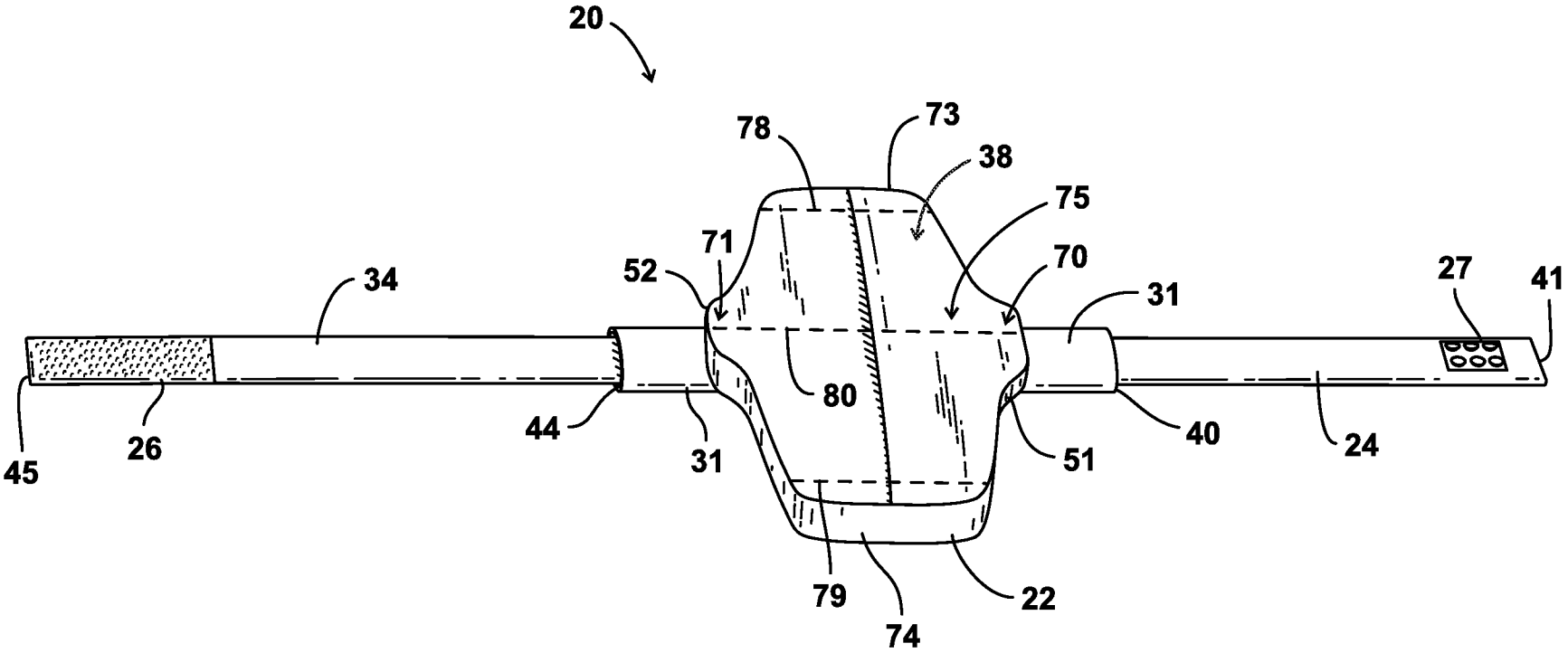
FIG. 3 is a rear perspective view of a preferred embodiment of the apparatus of the present invention.

Pad portion 21 can have an upper end 73 having a width 78, a lower end 74 having a width 79, and a middle portion 75. Middle portion 75 can have a width 80 that is greater than the width 78 of the upper end 73, as seen in FIGS. 1-3. Middle portion 75 can have a width 80 that is greater than the width 79 of the lower end 75, as seen in FIGS. 1-3. Middle portion 75 can have flaps, tabs or ears 71, 72 on each side of the middle portion 75 of pad portion 21, as seen in FIGS. 1 and 2. Pad portion 21 can be generally rectangular in shape as seen in at least FIG. 1, and can have laterally extending flaps, tabs or ears 71, 72 on each side portion 51, 52 of the pad portion 21.

FIG. 1 shows a preferred embodiment of the apparatus of the present invention, designated generally by the numeral 20. Boat motor cover 20 includes a protective pad portion 21 that is preferably comprised of an insert 23 encased in an outer shell 22. Insert 23 can be placed into shell 22 via an opening 48 preferably on a back side 38 of pad portion 21, as seen in FIG. 2. Opening 48 can be closed using a fastener 49, such as a hook and loop fastener, to preferably secure insert 23 in shell 22.

Figure 9:
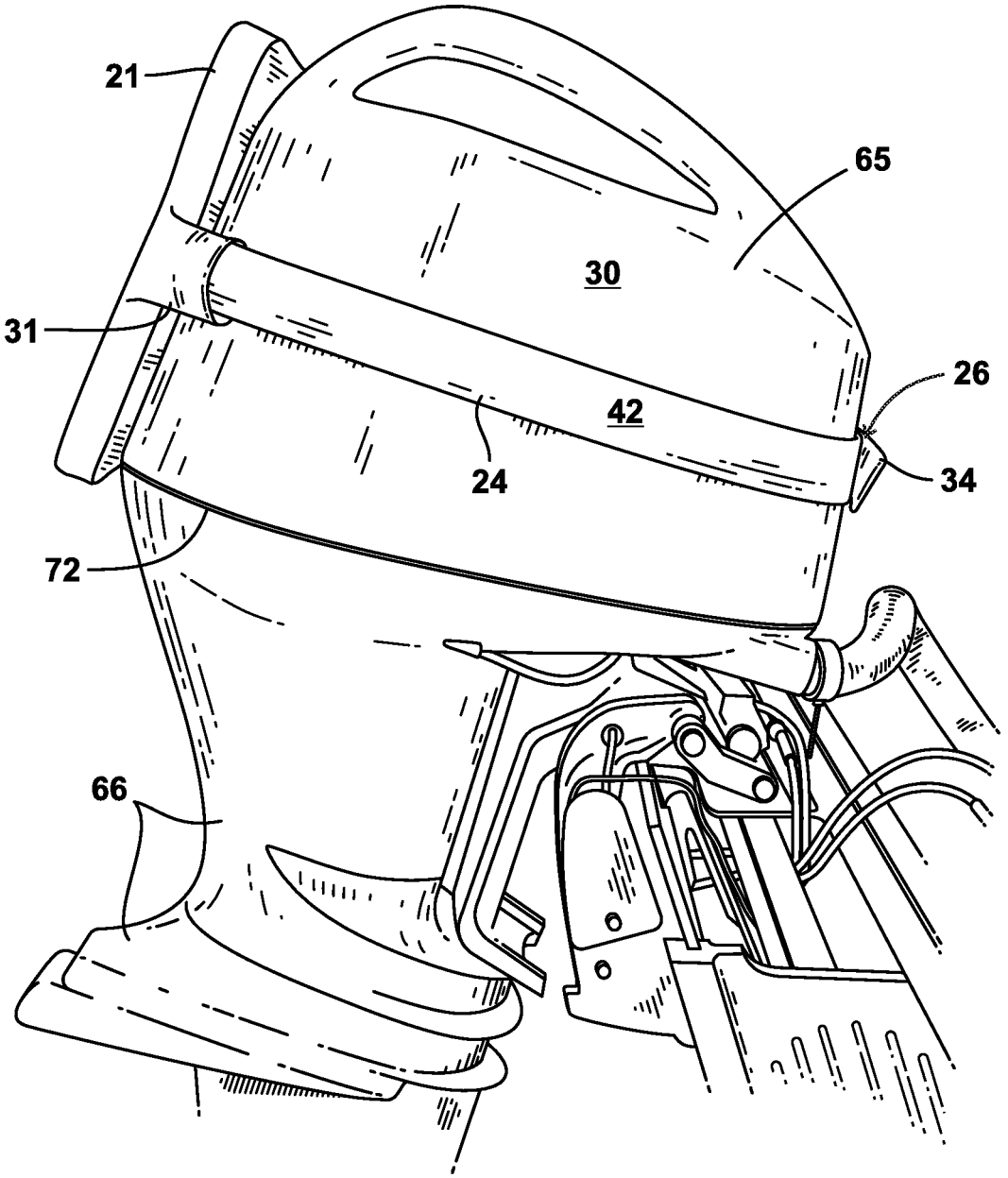
FIG. 9 is a side view of a preferred embodiment of the apparatus of the present invention showing the protective pad attached to a boat motor.
Figure 10:
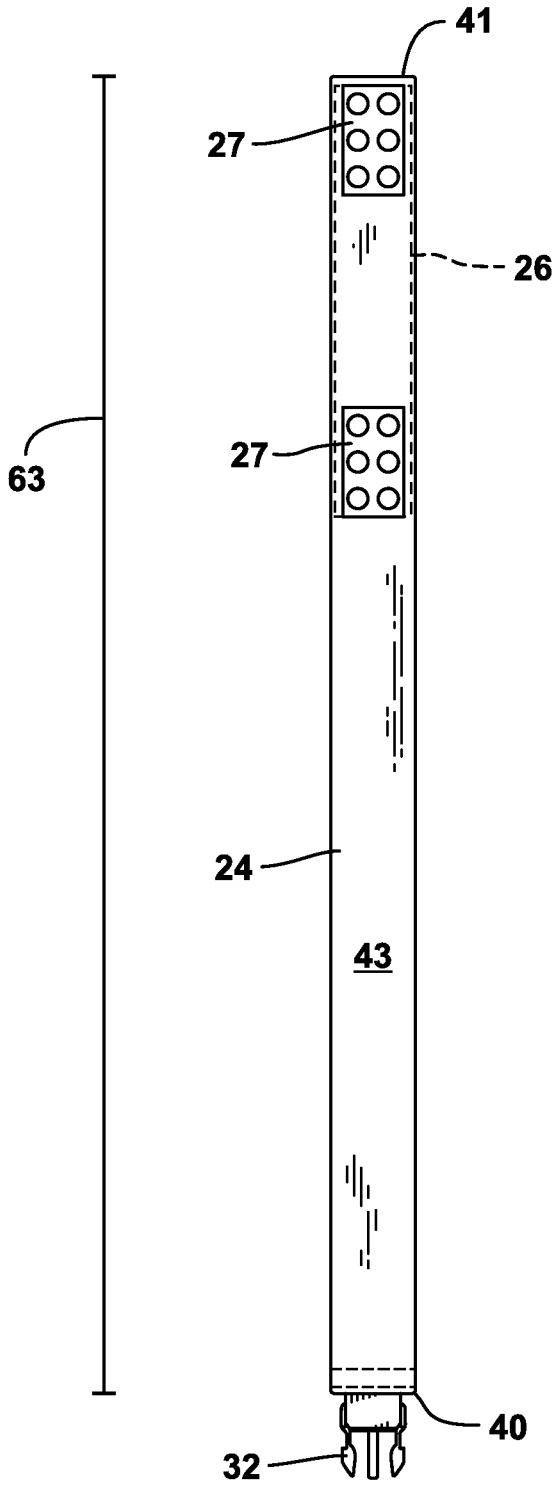
FIG. 10 is a back view of a preferred embodiment of the apparatus of the present invention showing strap 24.
Figure 11:
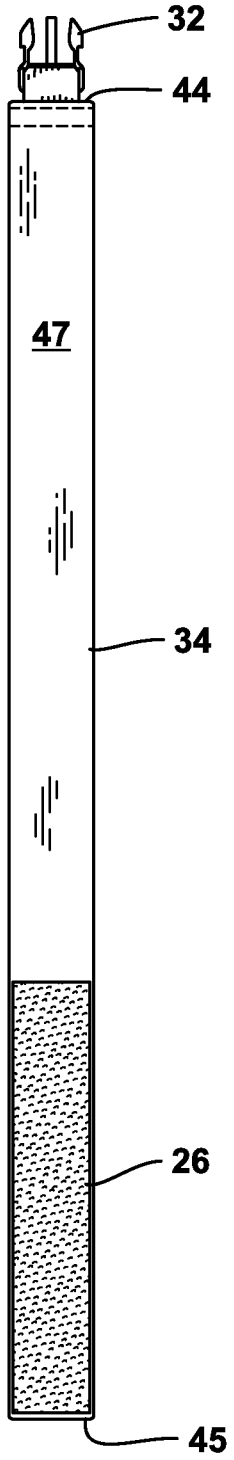
FIG. 11 is a back view of a preferred embodiment of the apparatus of the present invention showing strap 34.
Figure 12:
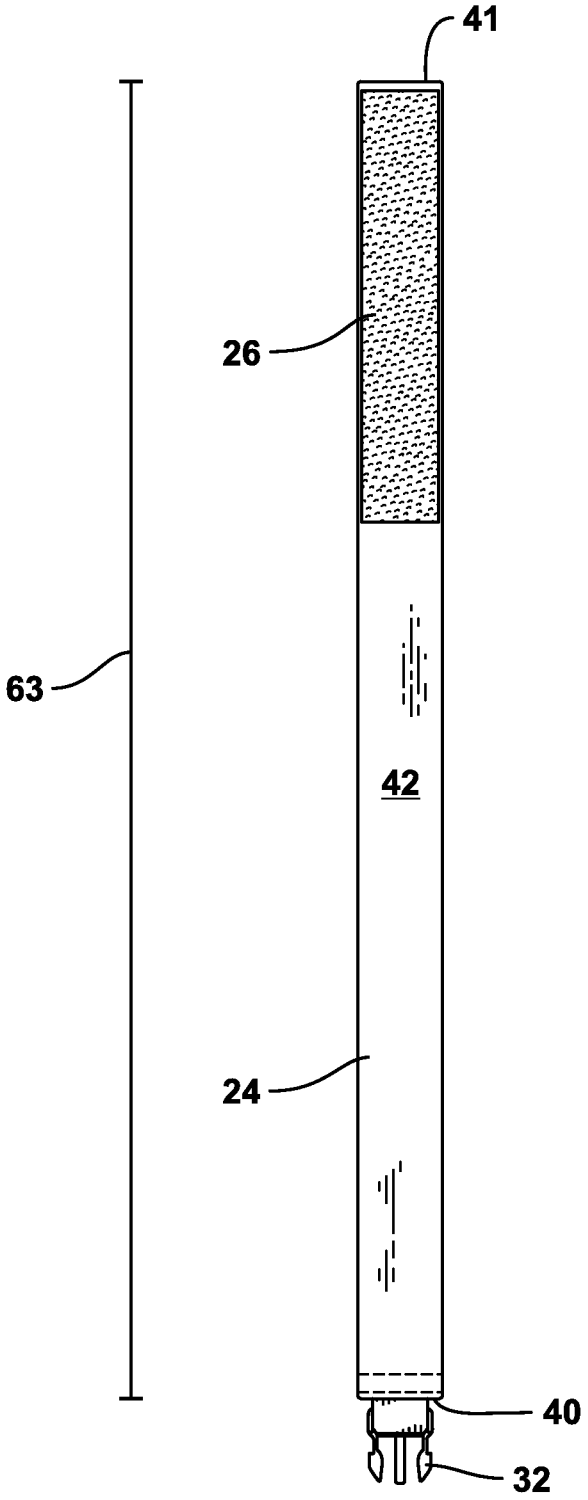
FIG. 12 is a front view of a preferred embodiment of the apparatus of the present invention showing strap 24.
Figure 13:
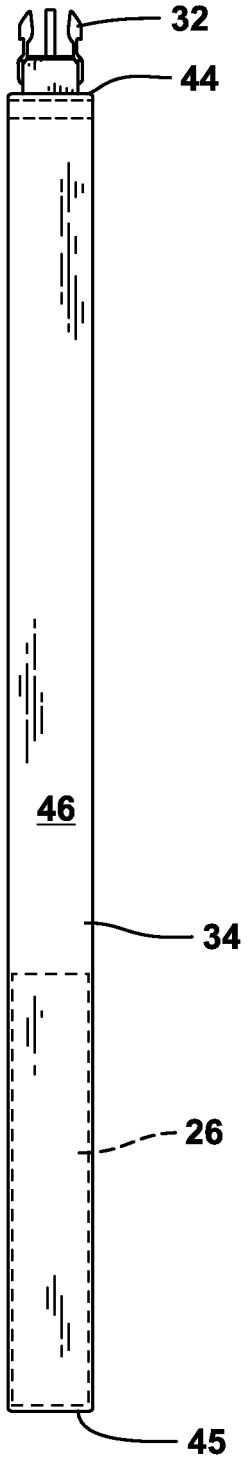
FIG. 13 is a front view of a preferred embodiment of the apparatus of the present invention showing strap 34.
Figure 14:
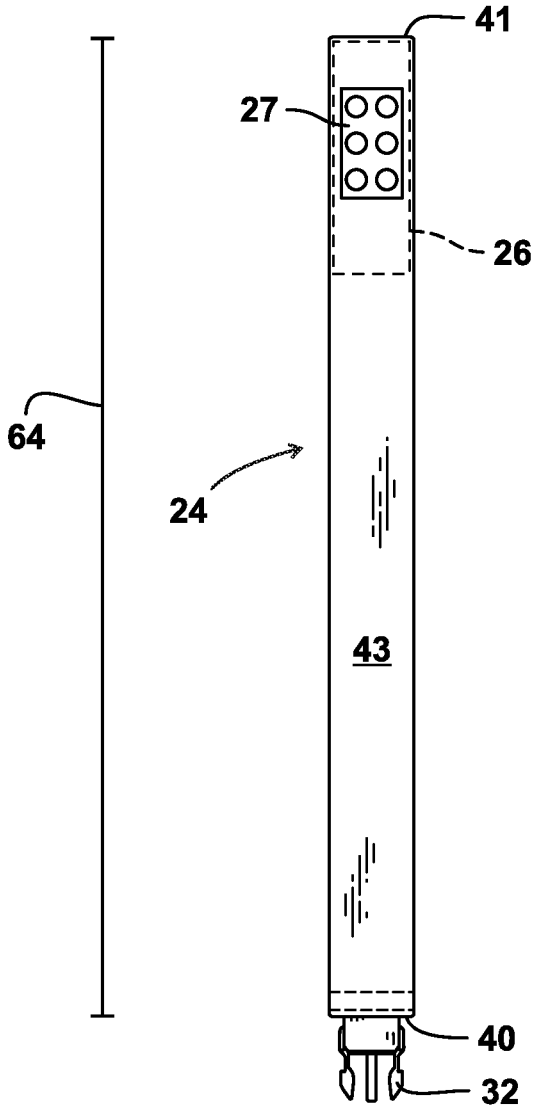
FIG. 14 is a back view of a preferred embodiment of the apparatus of the present invention showing strap 24.
Figure 15:
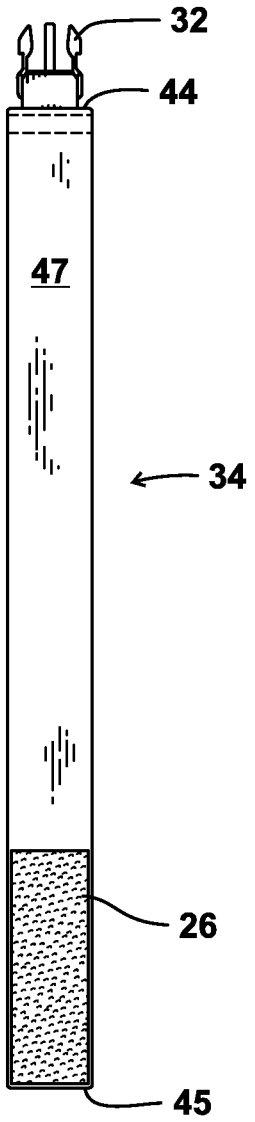
FIG. 15 is a back view of a preferred embodiment of the apparatus of the present invention showing strap 34.
Figure 16:
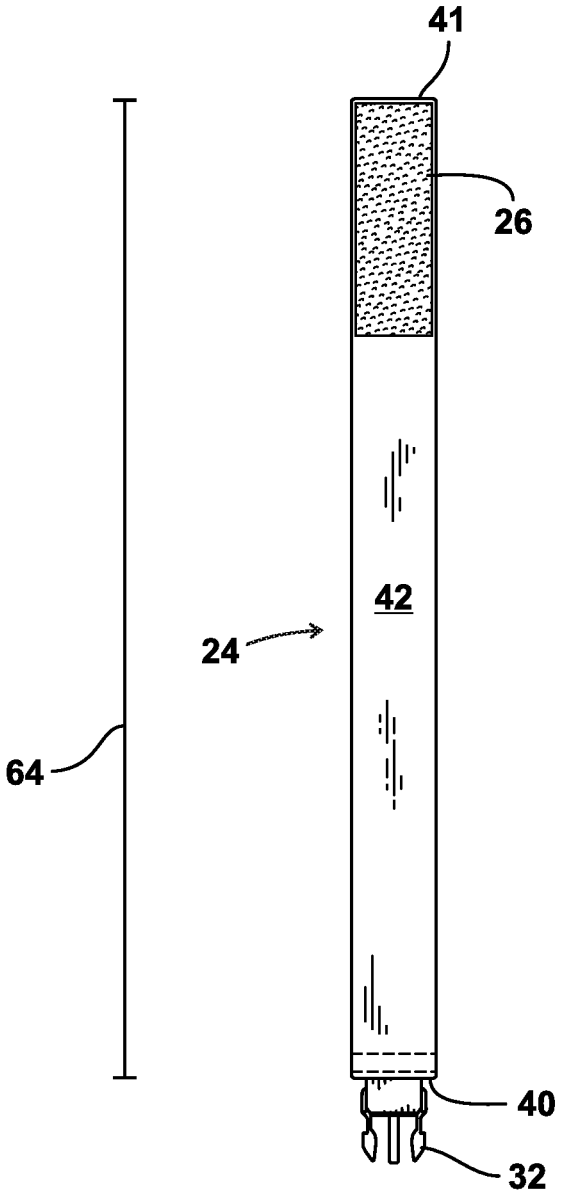
FIG. 16 is a front view of a preferred embodiment of the apparatus of the present invention showing strap 24.
Figure 17:
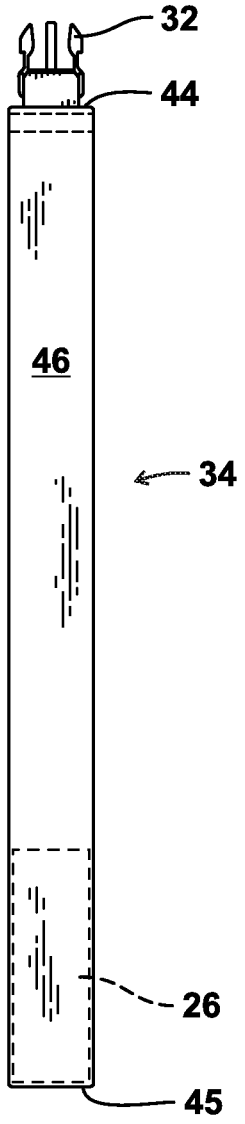
FIG. 17 is a front view of a preferred embodiment of the apparatus of the present invention showing strap 34.
Figure 18:
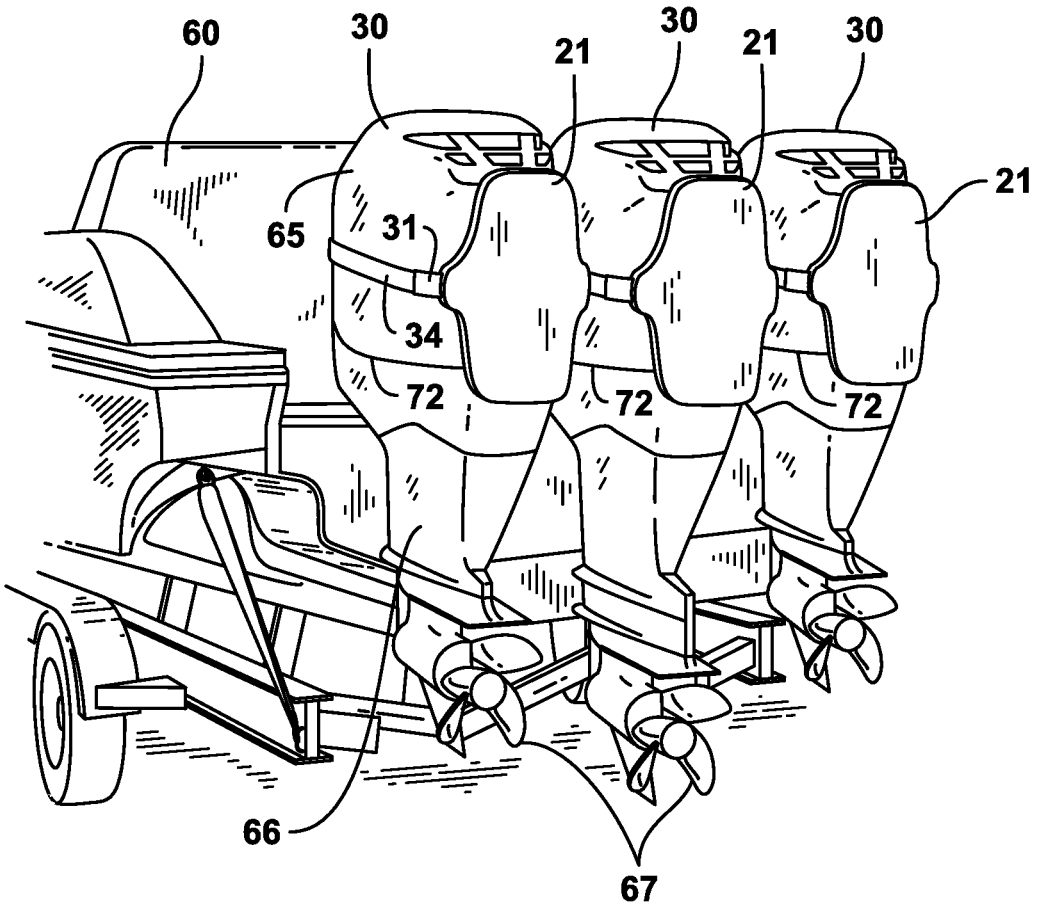
FIG. 18 is a rear partial perspective view of a preferred embodiment of the apparatus of the present invention showing the protective pads attached to boat motors.
Figure 19:
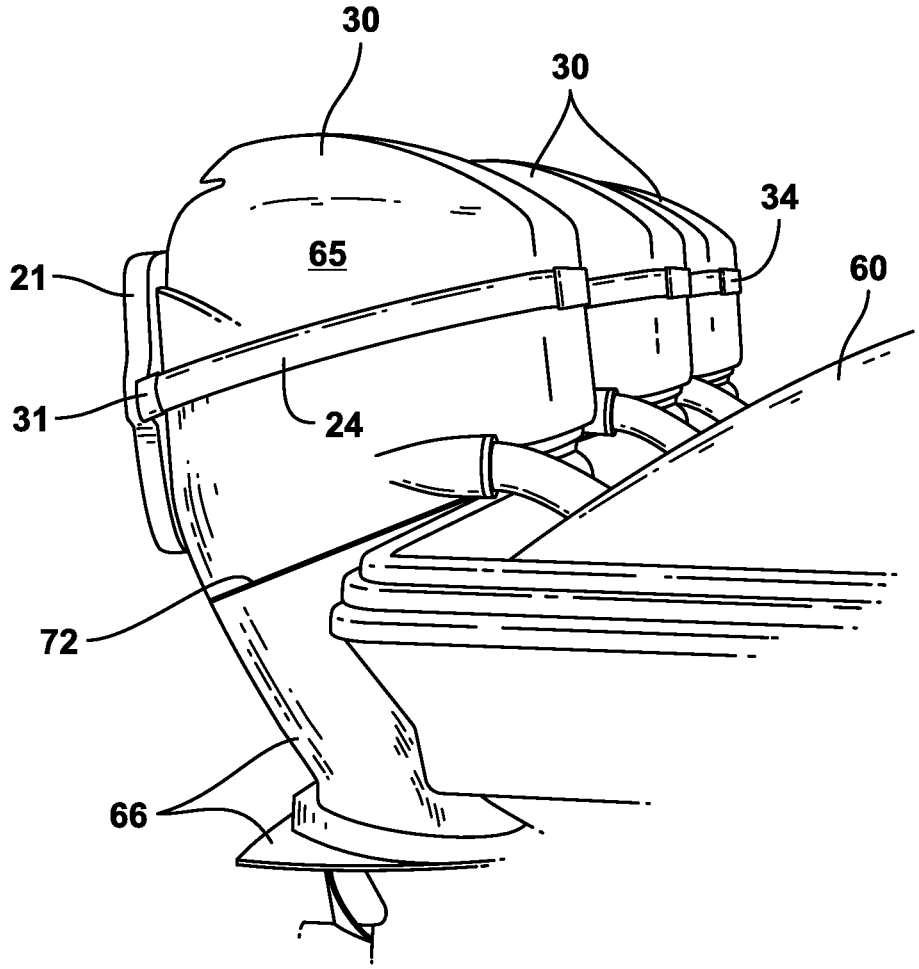
FIG. 19 is a side partial perspective view of a preferred embodiment of the apparatus of the present invention showing the protective pads attached to boat motors.

The apparatus of the present invention preferably uses lightweight, marine friendly materials that preferably allow for the pad portion 21 to hug or fit snuggly around a motor 30, as seen in FIGS. 9, 18 and 19. Insert 23 can be made of heavy-duty foam. The outer shell 22 is preferably made of a cloth or cloth-like material. More preferably, the outer shell 22 is made of a material that is waterproof, flexible, and resistant to water damage, such as neoprene (for example neoprene 3 mm sheets). Preferably, the outer shell 22 is soft, durable, stretchable material that gives a smooth, clean appearance and provides for abrasion protection for the engine 30. The outer shell 22 material can also allow for logos, boat names, advertising, and the like, for example, to be printed on it. In some embodiments, the insert 23 can be comprised of at least two layers of foam. Preferably, at least one layer of foam is 4# XL PE Black. Preferably, at least one layer of foam is 4# Ether Charcoal. Preferably, the at least two layers of foam are bonded together with industrial upholstery glue.

Preferably, the protective pad portion 21 has a front side 39 and a back side 38 wherein the back side 38 is preferably in contact with the motor 30, and the front side 39 preferably provides protection from, for example, a bulkhead of docking wall. The apparatus 20 also preferably includes straps 24, 34 preferably on either side 51, 52 of pad portion 21. Straps 24, 34 can be used for securing the protective pad portion 21 to the motor 30. Preferably, straps 24, 34 can be made of a material similar to the outer shell, that is waterproof, flexible, and resistant to water damage, such as neoprene (for example neoprene 3 mm sheets). Preferably, straps 24, 34 are between about 30 and 50 inches in length, more preferably they are between about 35 and 45 inches in length, and most preferably, they are about 41 inches in length.

FIGS. 10-13 show straps 24, 34 in a longer length 63 that can be used for a larger sized motor 30. Straps having a length 63 can include multiple suction devices 27 and/or longer/additional fasteners 26 for attachment on motor 30. FIGS. 14-17 show straps 24, 34 in a shorter length 63 that can be used for a regular or smaller sized motor 30.

Figure 4:
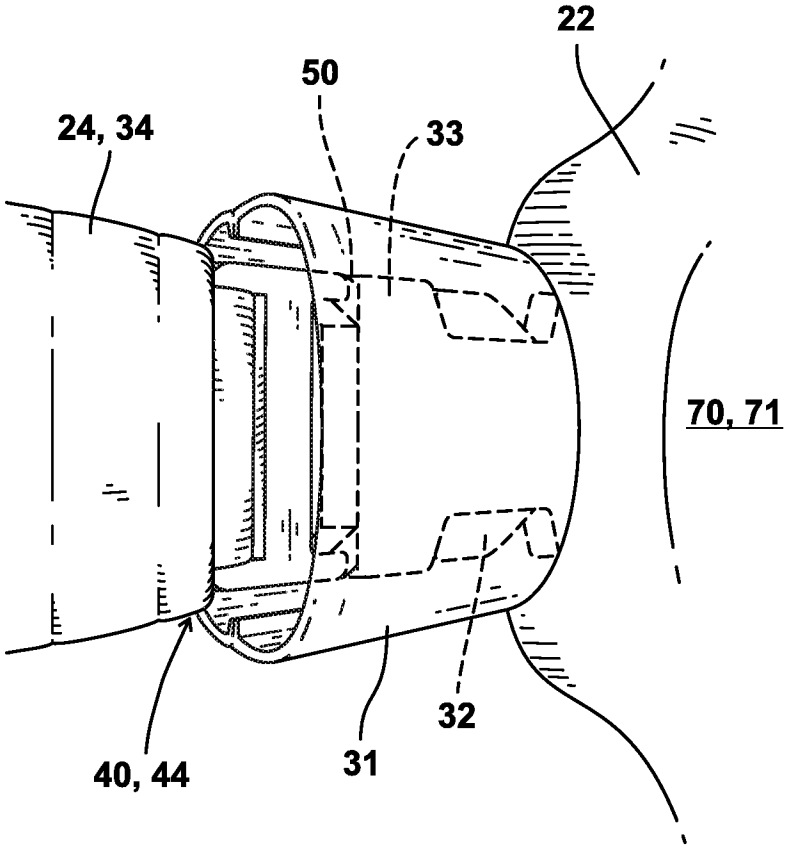
FIG. 4 is a partial perspective view of a preferred embodiment of the apparatus of the present invention.
Figure 5:
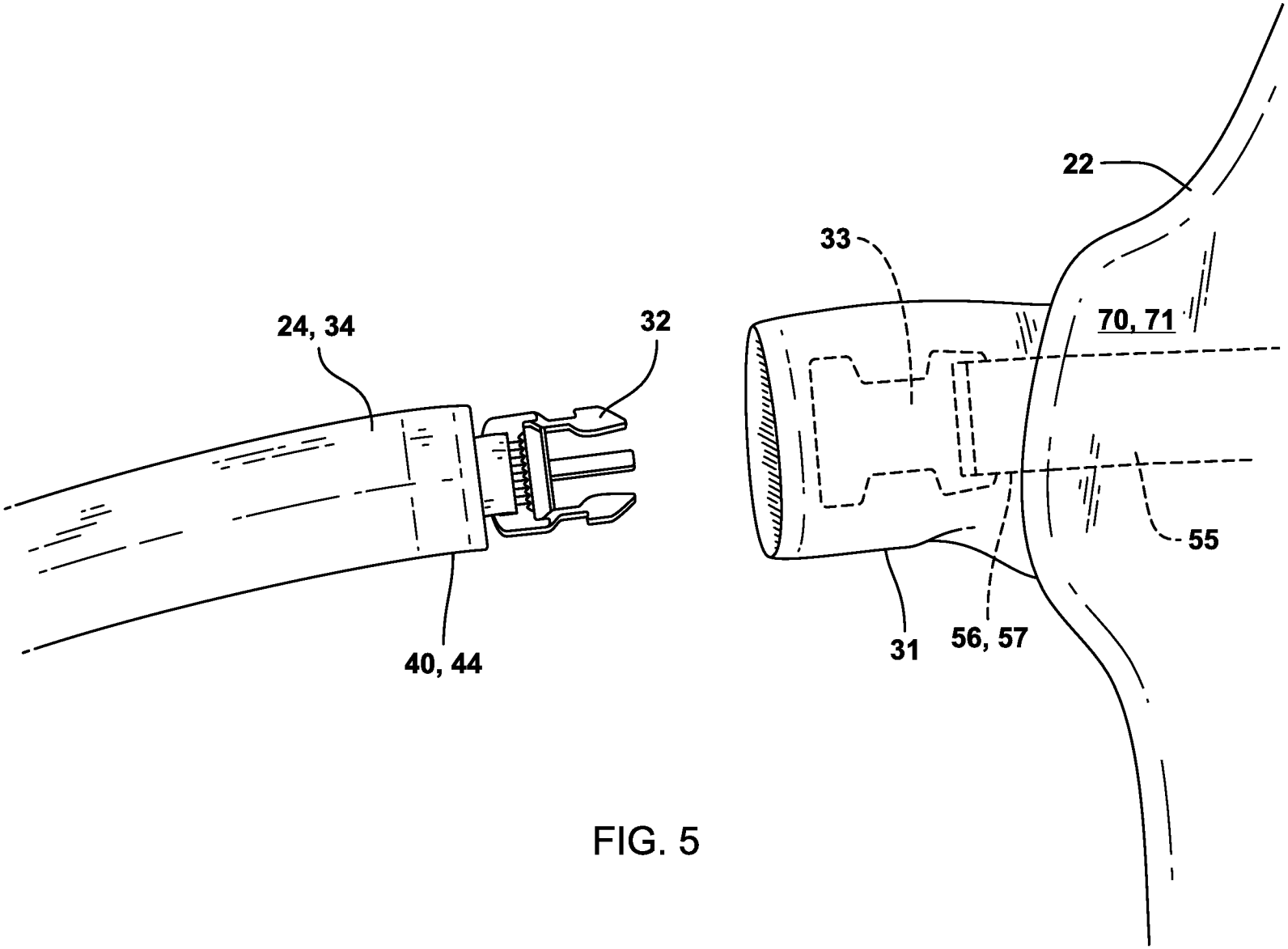
FIG. 5 is a partial perspective view of a preferred embodiment of the apparatus of the present invention.

Preferably, the straps 24, 34 are removably attached to the protective pad portion 21 with a clip or fastener 50. Clip or fastener 50 can be made up of a female clip 33 and a male clip 32, as seen in FIG. 4. Preferably, a male clip 32 is provided on each of straps 24, 34, as seen in FIGS. 10-17. Male clip 32 on strap 24, 34 can attach to a corresponding female clip 33 that can be provided on a side 51, 52 of protective pad portion 21 (see FIG. 4). Preferably, there are two female clips 33 on the protective pad portion 21, one on each side 51, 52 of the pad 21. Preferably, the outer shell 22 includes clip cover 31 on each side 51, 52 that preferably covers the clips 33 on each side (left and right) 51, 52 of the pad 21, as seen in FIG. 3. Cover 31 can also cover the connected clips or fasteners 50, as seen in FIG. 4.

Figure 6:
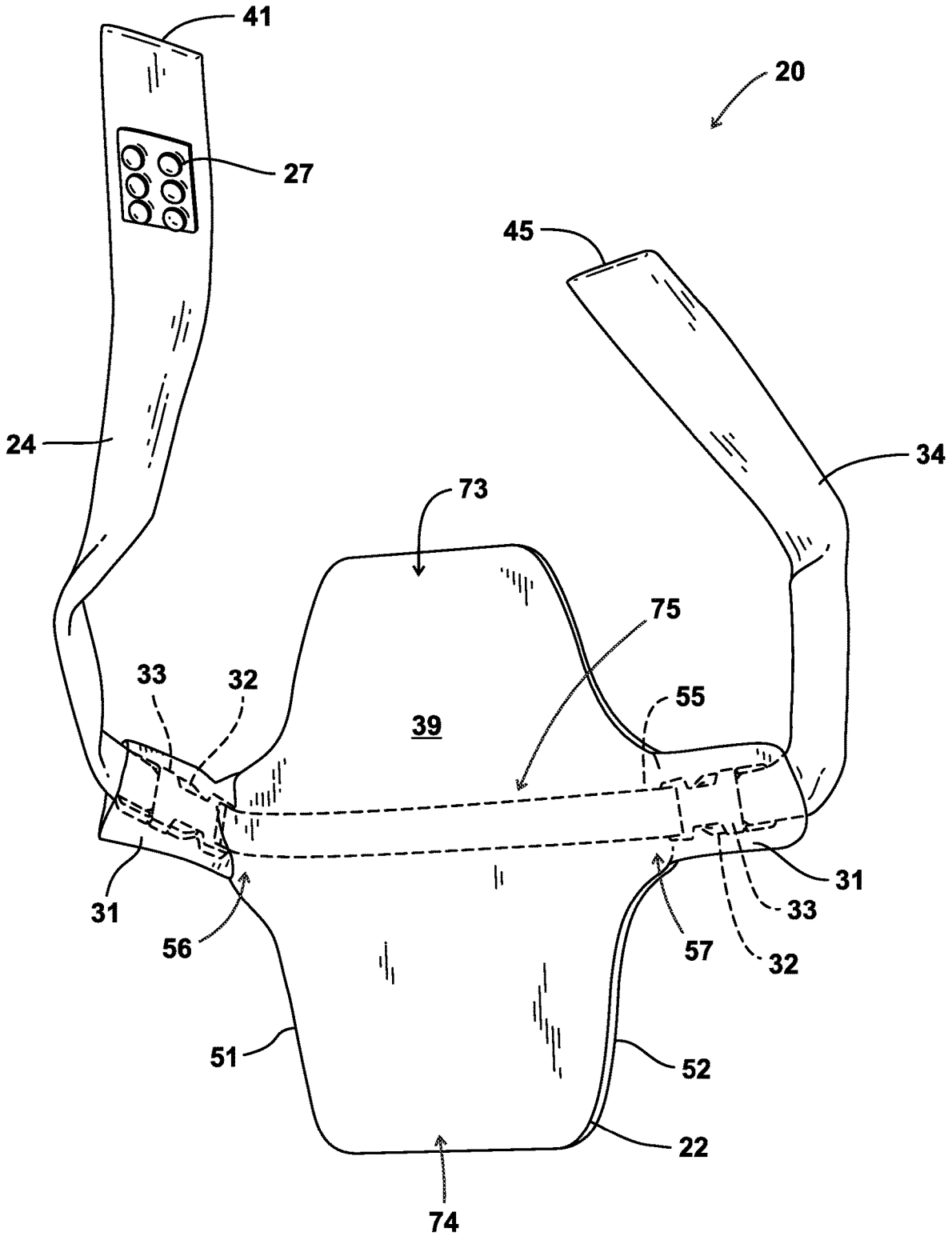
FIG. 6 is a front perspective view of a preferred embodiment of the apparatus of the present invention.
Figure 7:
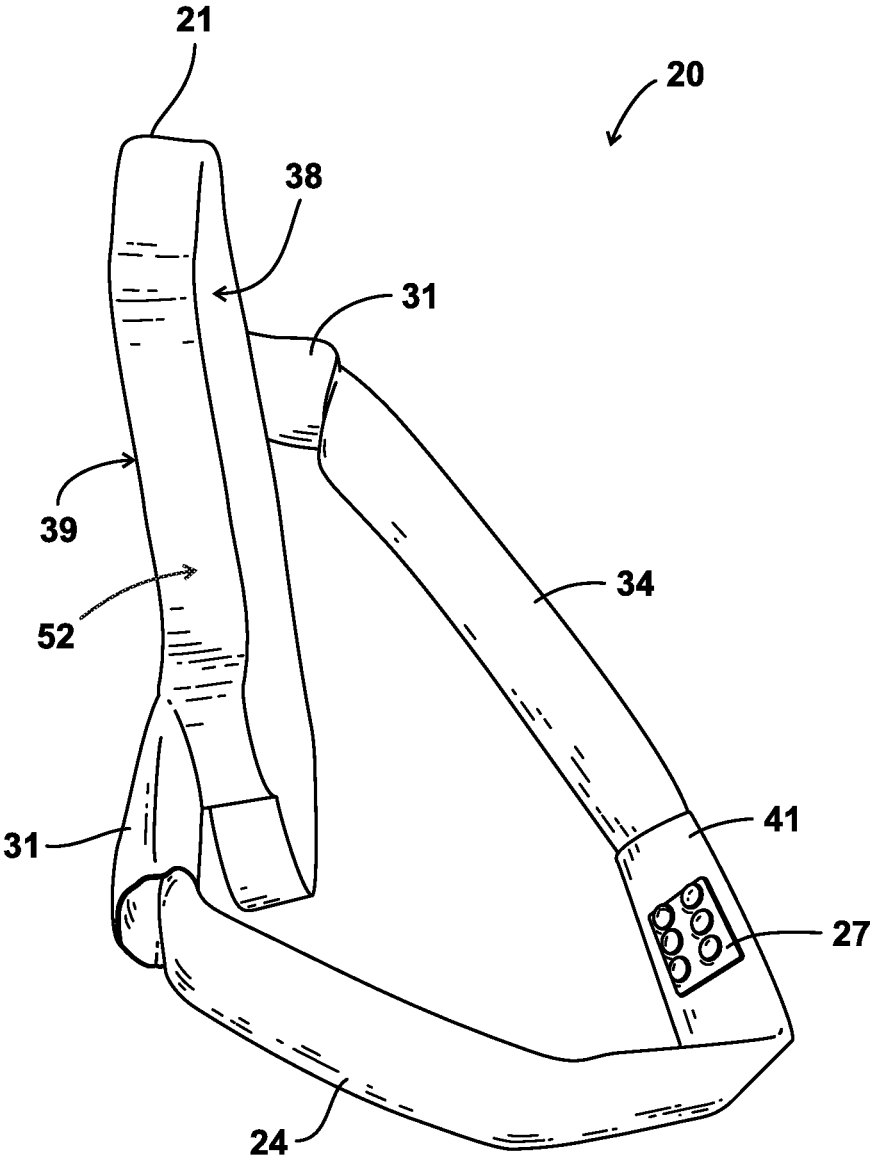
FIG. 7 is a side perspective view of a preferred embodiment of the apparatus of the present invention.

An interior strap 55 having ends 56, 57 can be located inside shell 22. End 56 of strap 55 can attach to female clip 33 on pad side 51. End 57 of strap 55 can attach to the other female clip 33 on the other pad side 52. Interior strap 55 can run along the inside of the front side 39 of shell 22, as seen in FIG. 6, preferably portioned behind insert 23. Interior strap 55 preferably adds support to the protective device 20, preferably creating full coverage around the motor 30 by fully encircling motor. Strap 55 ends 56, 57 preferably connect to female clips 33 on each pad side 51, 52; female clips 33 preferably connect to male clips 32 on straps 24, 34; straps 24 and 34 preferably attached to each other.

Figure 8:
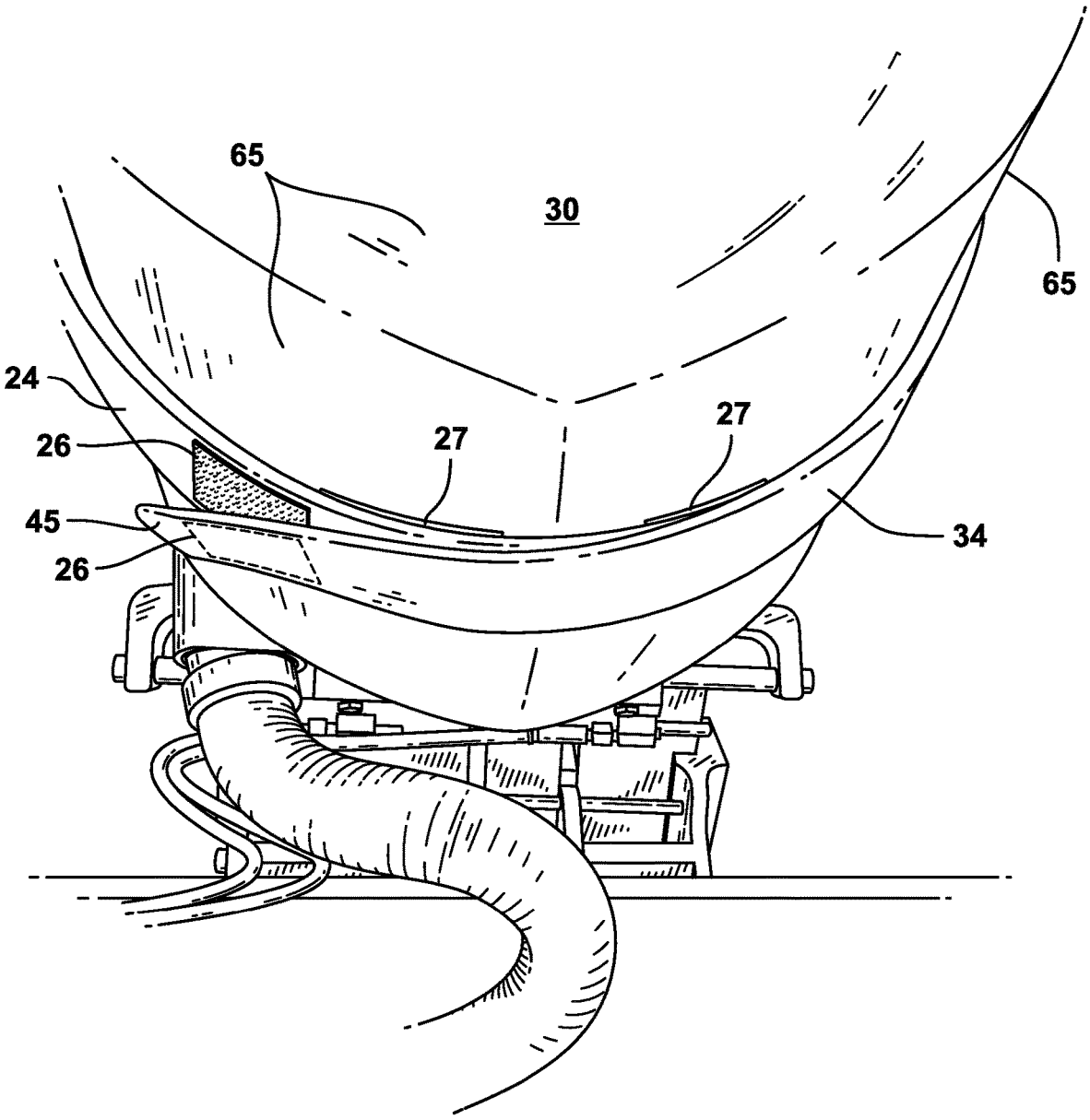
FIG. 8 is a top fragmentary view of a preferred embodiment of the apparatus of the present invention showing the straps attached to a boat motor.

Straps 24, 34 can attach to each other to preferably secure pad portion 21 to motor 30. Preferably, strap 24 has first end portion 40, a second, distal end portion 41, a front side 42 and a back side 43. First end portion 40 of strap 24 can have a male clip 32, which preferably attaches to female clip 33 provided on a side of protective pad 21. Second end or distal end portion 41 of strap 24 can be attached to strap 34. Back side 43 of strap 24 is preferably in contact with the motor 30. Preferably the strap 24 has one or more suction devices 27 located on the back side 43 at the second, distal end portion 41 for securing the pad portion 21 to the motor 30, as shown in FIGS. 8, 9.

Preferably, strap 34 has first end portion 44, a second, distal end portion 45, a front side 46 and a back side 47. First end portion 44 of strap 34 can have a male clip 32, which preferably attaches to a female clip 33 on a side of protective pad 21. Second end or distal end portion 45 of strap 34 can be attached to strap 24. Back side 47 of strap 34 is preferably in contact with the motor 30.

Preferably strap 24 has a fastener 26 (such as hook at loop fastener) located on the front side 42 preferably at the second, distal end portion 41 for attaching to strap 34. Preferably, strap 34 has a fastener 26 (such as hook at loop fastener) preferably provided on the back side 47 preferably at the second, distal end 45 of strap 34, for attaching strap 34 to strap 24. Fastener 26 on front side 42 of strap 24 is preferably attached to fastener 26 on back side 47 of strap 34 to secure pad portion 21 on the motor 30, as seen in FIGS. 8, 9.

The apparatus of the present invention 20 can be made to allow for slight up-and-down movement of the pad 20 on the motor 30, as the motor 30 is pushed or moved with the wake/water, the pad 20 does not fall off. When installed properly, the motor protection pad 20 of a preferred embodiment of the present invention should not move from side-to-side. This embodiment is designed specifically for outboard motors, as shown in FIGS. 8, 9, 18, 19. The straps 24, 34 can be made of elastic, flexible rubber material, neoprene, or any other suitable material. Preferably, the straps 24, 34 are made of a material that can withstand sun, water, weather, and other damaging effects.

In one embodiment of the apparatus of the present invention, insert 23 is preferably a heavy-duty foam piece made of a highly durable and impact resistant 4# XL PE foam board that can preferably take the brunt of impacts between the engine cover 30 and the dock or mooring; however, higher or lower density materials, or other suitable materials could also be used. In one embodiment of the apparatus of the present invention, there is a durable yet soft 4# Ether Charcoal foam sheet, or other suitable material, behind the XL PE foam board to provide a soft cushioning effect against the motor 30. Preferably, the XL PE foam board or other suitable material, and 4# Ether Charcoal foam sheet, or other suitable material, are bonded together. Preferably, the bonding material is industrial upholstery glue.

Preferably, the protective pad cover 22 is removably secured over the insert 23. Insert 23 can be placed in opening 48 of cover 22. Cover 22 can be secured to the insert 23 using any suitable fastener 49, for example hook and loop fasteners, as seen in FIG. 2.

In one embodiment, the insert 23 can have a length of preferably about 20.5-27 inches, and most preferably a length of about 23.5 inches. In one embodiment, the insert 23 can have a width of preferably about 10-25 inches at its widest point, and most preferably, a width of about 17.5 inches at its widest point. In one embodiment, the insert 23 can have a width of preferably about 6-17 inches at its top and bottom, and most preferably, a width of about 9 inches at its top and bottom. In one embodiment, the insert 23 can have a thickness of preferably about 0.5-3 inches, and most preferably, a thickness of about 1 inch. The protective pad portion 21 may be any suitable size and shape; however, it must not extend to a point where it interferes with the operation of the motor.

Figure 23:
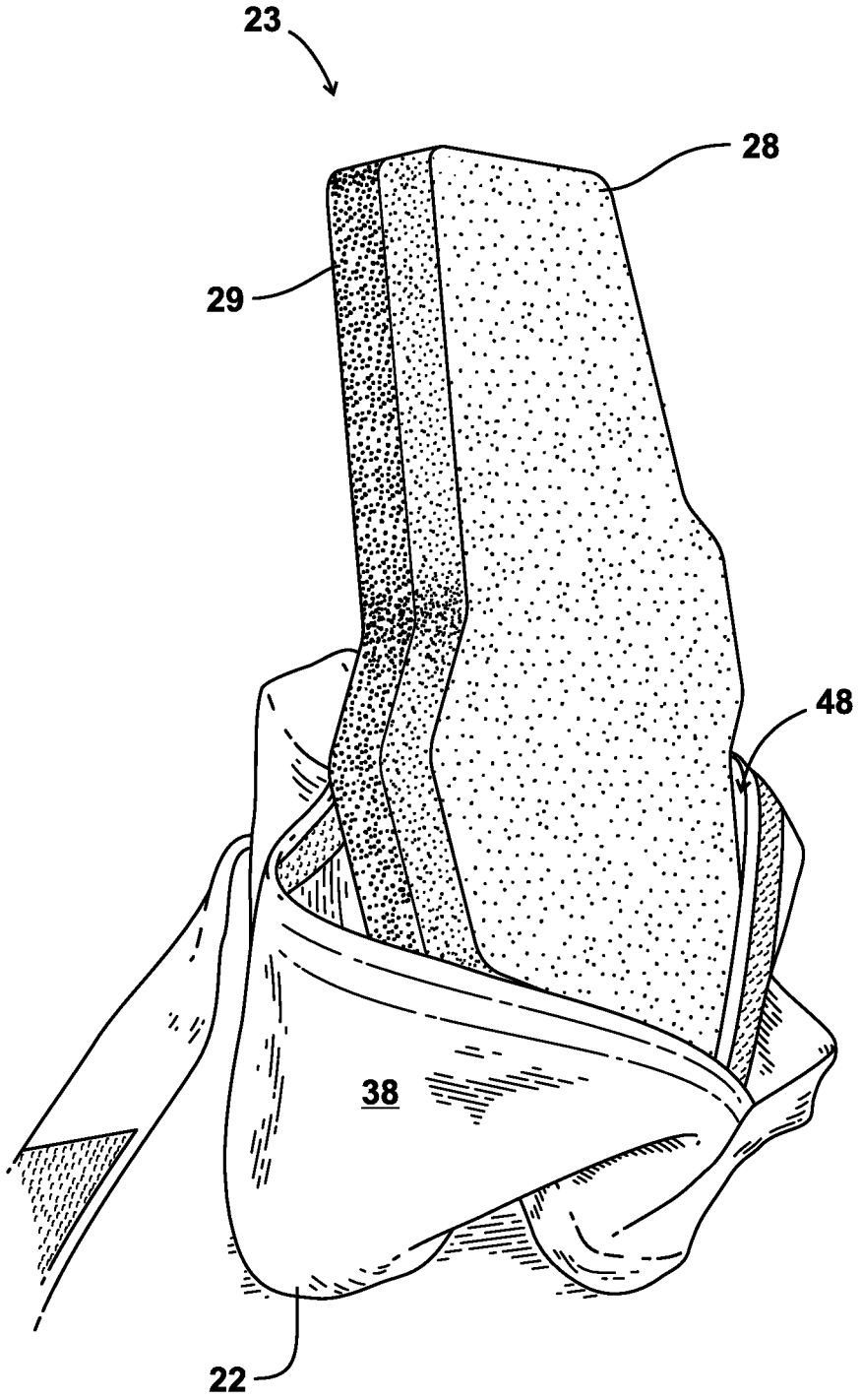
FIG. 23 is a perspective view of a preferred embodiment of the apparatus of the present invention showing the layered insert in the pad cover.
Figure 24:
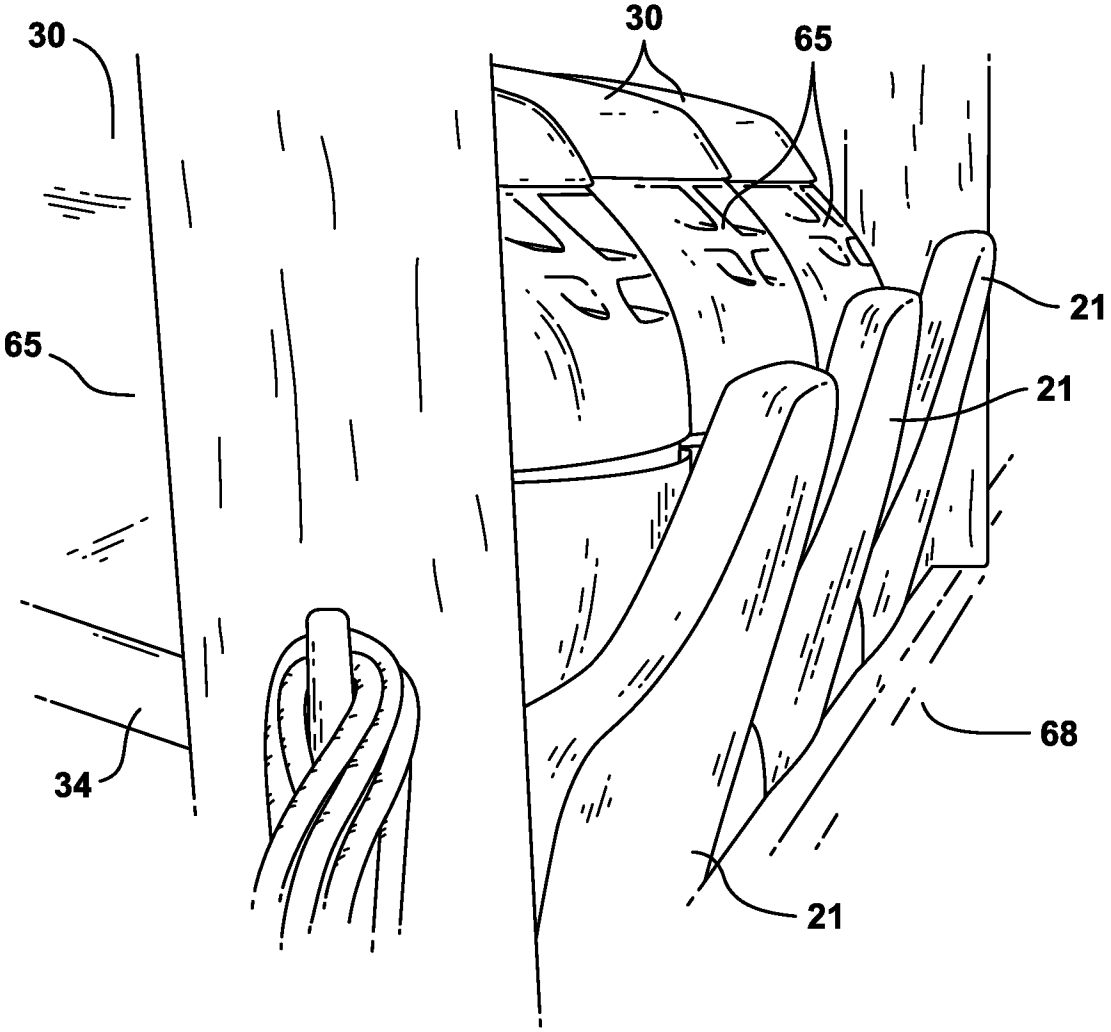
FIG. 24 is a partial perspective view of a preferred embodiment of the apparatus of the present invention showing the protective pads attached to boat motors and pressed up against a dock.
Figure 25:
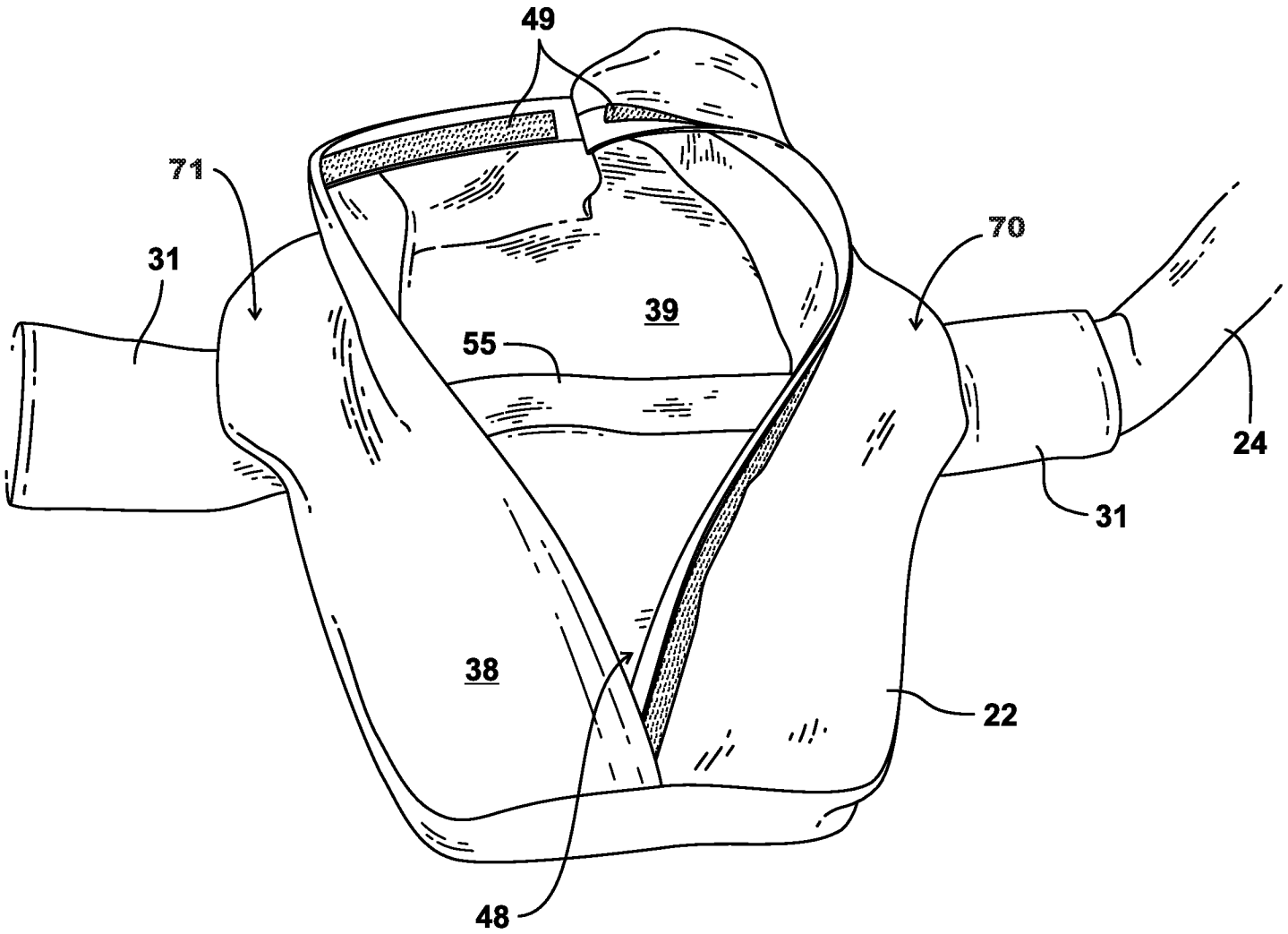
FIG. 25 is a partial perspective view of a preferred embodiment of the apparatus of the present invention showing an interior strap in the pad cover/shell.

In a preferred embodiment, insert 23 is comprised of at least two layers of foam, as seen in FIG. 23. Preferably, a first layer 28 is a softer material for contacting the motor 30, such as for example 4# Ether Charcoal foam sheet. Preferably a second layer 29 is a harder quality foam, such as for example XL PE foam board. Preferably, the two layers 28, 29 are bonded together with industrial upholstery glue.

In one embodiment of the apparatus 20 of the present invention, protective pad 20 has a series of suction cups 27 in the form of a fitted pad that can preferably hold the straps 24, 34 in place on the forward facing side of the engine 30. Fasteners 26 on straps 24, 34, as seen in FIGS. 10-17, can preferably be complementary pieces of hook and loop fasteners used to attach straps 24, 34 together. Fastener 26 on front side 42 of strap 24 is preferably attached to fastener 26 on back side 47 of strap 34 to secure pad portion 21 on the motor 30, as seen in FIGS. 8, 9. The attachment of straps 24 and 34 preferably allow for adjustments necessary to allow for maximization of strength when wrapping straps 24, 34 around the engine 30. Preferably, the hook and loop fasteners 26 are Velcro® brand. The piece of Velcro® can have a length of preferably about 4-16 inches, and most preferably, a length of about 8 inches, and a width of preferably about 1-6 inches, and most preferably, a width of about 3 inches.

The suction device 27 is preferably a 58 MM suction pad per unit. Preferably, the suction device 27 is a pad that comprises at least 6 suction cups. Suction device pad can comprise many suction cups.

The present invention includes a method of using the protective device 20 to protect an outboard boat motor 30. Preferably the method comprises steps of:

a) placing the back side 38 of the protective pad portion 21 against the outboard motor 30 where protection is needed, as seen in FIG. 9;

b) wrapping strap 24 around the motor 30 and attaching suction device 27 to the motor 30, as seen in FIG. 8;

c) wrapping strap 34 around the motor 30 and attaching it to strap 24 with fastener 26, as seen in FIG. 9.

Figure 20:
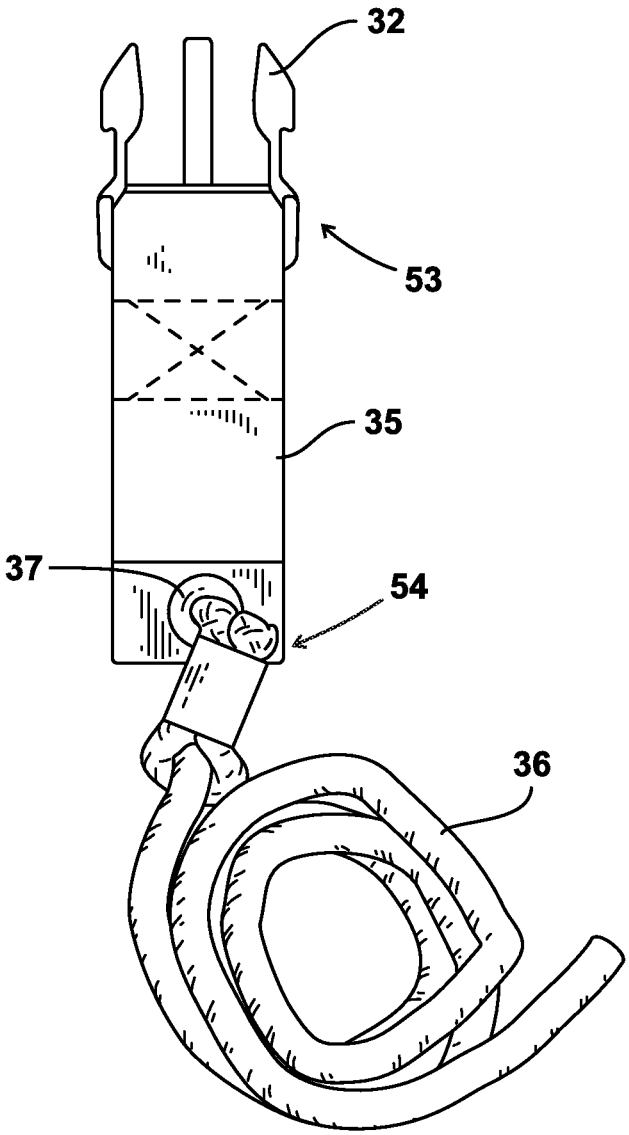
FIG. 20 is a perspective view of a preferred embodiment of the apparatus of the present invention showing the adapter.
Figure 21:
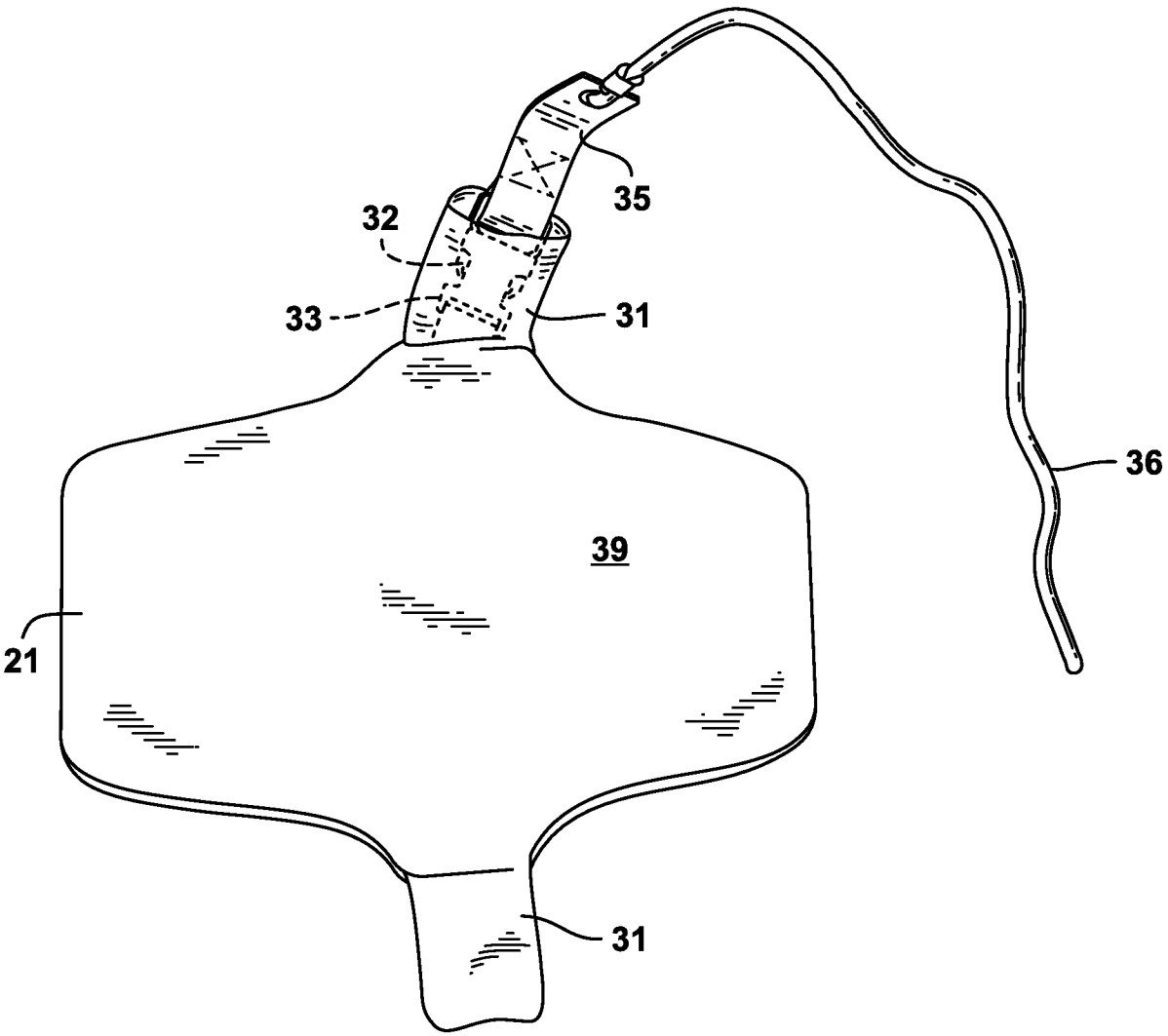
FIG. 21 is a perspective view of a preferred embodiment of the apparatus of the present invention showing the adapter attached to the protective pad.
Figure 22:
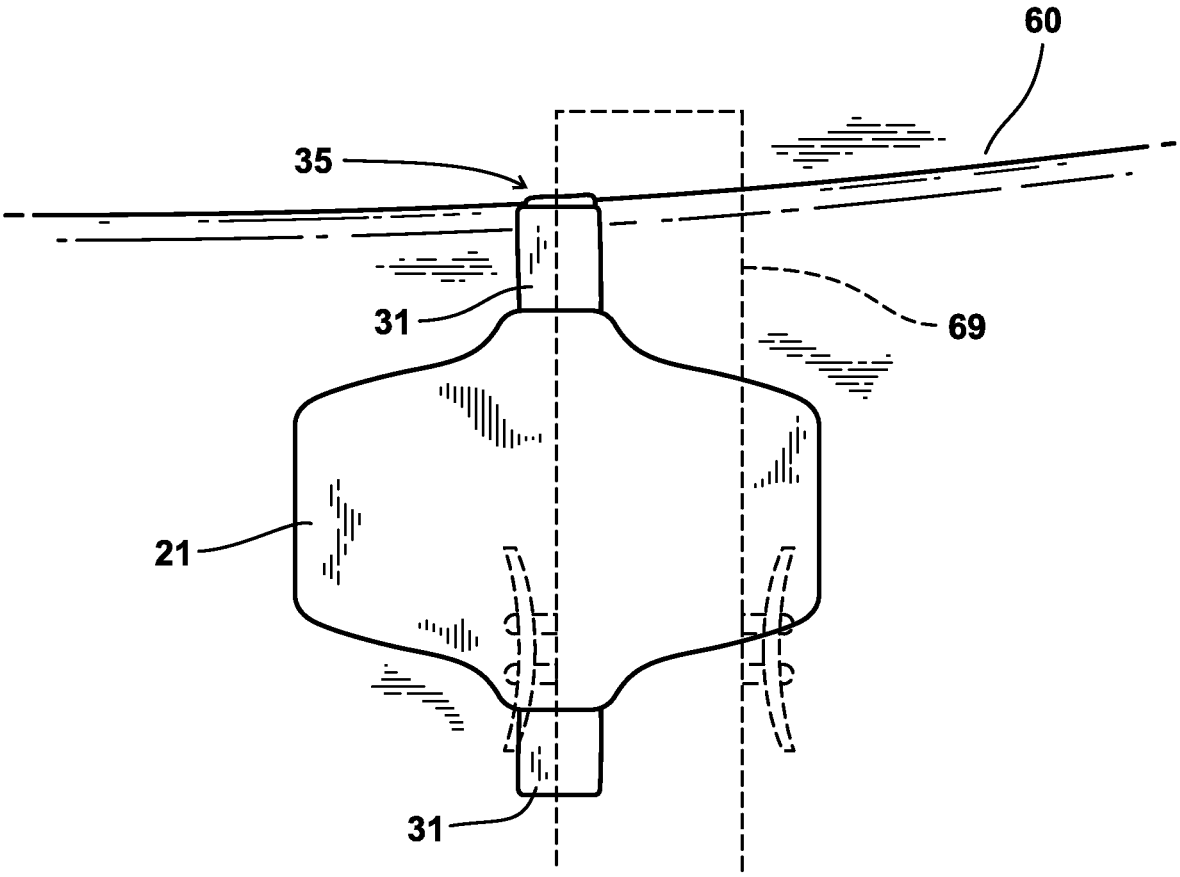
FIG. 22 is a partial perspective view of a preferred embodiment of the apparatus of the present invention showing the adapter attached on a boat and connected to the protective pad.

In some embodiments, the apparatus 20 can be adapted for use as a protective pad for the side of a boat 60 by using adapter 35 as shown in FIGS. 20, 21. Adapter 35 can have a male clip 32 at adapter end portion 53 and a rope 36 at adapter end portion 54, as seen in FIG. 20. The present invention includes a method of using the adapter 35 to convert the protective pad 20 into a pad for protecting a side of a boat 60, the method preferably comprising the steps of:

a) removing one of the straps 24, 34 from the protective pad portion 21 by disengaging the male clip 32 on the strap 24, 34 from the female clip 33 on the pad 21;

b) connecting the male clip 32 of adapter 35 to the female clip 33 on the pad 21, as seen in FIG. 21;

c) using rope 36 connected to the adapter 35 end 54 via an eyelet or grommet 37 to connect the adapter 35 to a boat 60, and d) allowing the pad 21 to hang over the edge of the boat 60 thereby protecting the side of the boat 60.

Preferably, the rope 36 can be adjusted in length to allow the pad 21 to be placed at the appropriate level for maximum protection of the side of the boat 60.

The device 20 of the present invention can be used as a recreational floatation device when not in use on a motor 30 or side of the boat 60.

The following is a list of parts and materials suitable for use in the present invention:

PARTS LIST:

| Reference Numeral | Description |
|---|---|
| 20 | motor cover |
| 21 | protective pad portion |
| 22 | protective pad cover |
| 23 | insert/foam piece |
| 24 | strap |
| 25 | end portion |
| 26 | fastener |
| 27 | suction device |
| 28 | foam piece, first layer |
| 29 | foam piece, second layer |
| 30 | boat motor/engine |
| 31 | clip cover |
| 32 | clip/fastener (male) |
| 33 | clip/fastener (female) |
| 34 | strap |
| 35 | adapter |
| 36 | rope |
| 37 | eyelet/grommet |
| 38 | back side of protective pad |
| 39 | front side of protective pad |
| 40 | first end of strap |
| 41 | second end of strap |
| 42 | front side of strap |
| 43 | back side of strap |
| 44 | first end of strap |
| 45 | second end of strap |
| 46 | front side of strap |
| 47 | back side of strap |
| 48 | opening |
| 49 | fastener |
| 50 | clip/fastener |
| 51 | side of pad 21 |
| 52 | side of pad 21 |
| 53 | adapter end |
| 54 | adapter end |
| 55 | interior strap |
| 56 | strap end |
| 57 | strap end |
| 60 | boat |
| 63 | length of strap |
| 64 | length of strap |

-continued

PARTS LIST:

| Reference Numeral | Description |
|---|---|
| 65 | upper portion or cowl/cowling/powerhead |
| 66 | lower/lower unit |
| 67 | propeller |
| 68 | dock |
| 69 | pier/piling |
| 70 | flap/tab/ear |
| 71 | flap/tab/ear |
| 72 | lower edge of cowl/cowling/powerhead |
| 73 | top end portion of pad 21 |
| 74 | bottom end portion of pad 21 |
| 75 | middle portion of pad 21 |
| 78 | width of top end 73 |
| 79 | width of bottom end 74 |
| 80 | width of middle portion 75 |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An outboard boat motor protection device for protecting a boat outboard motor power head having a propeller, comprising:

a) a cowling that includes a pad portion, wherein the cowling is removably connectable to the outboard motor and enveloping the power head, said cowling having a front end, a back end, side portions, a top panel, and a lower edge;

b) the pad portion having a top end, a bottom end, a middle section, a front side, and a back side, said pad portion including a shell and an inflexible insert sized and shaped to be encased in the shell, said insert comprising one or more layers of foam material;

c) one or more pad straps removably attached to said pad middle section with a fastening device, said one or more pad straps extending along the cowling side portions and front end to immovably secure said pad portion front side to the cowling back end;

d) an interior strap having end portions and positioned inside the shell, wherein said interior strap extends across the pad middle section and said interior strap end portions removably connect to said one or more pad straps via said fastening device;

e) wherein said interior strap is positioned in between the shell and insert near said pad portion back side;

f) one or more securing devices on said one or more pad straps adapted to secure said one or more pad straps to said cowling side portions and front end;

g) wherein said pad portion is sized and shaped to cover a majority of the cowling back end, and wherein said pad portion extends above and below said one or more pad straps;

h) wherein said one or more pad straps are positioned in between the cowling top panel and the cowling lower edge and extend around said cowling at the pad portion middle section.

2. The outboard boat motor protection device of claim 1, wherein the pad portion extends below the cowling lower edge.

3. The outboard boat motor protection device of claim 1, wherein the middle section tapers to said top and bottom ends.

4. The outboard boat motor protection device of claim 1, wherein said one or more pad straps comprise at least two straps that removably connect to each other via a hook and loop fastener.

5. The outboard boat motor protection device of claim 1, wherein said securing devices include suction devices.

6. The outboard boat motor protection device of claim 1, wherein the fastening device includes a male clip and a female clip.

7. The outboard boat motor protection device of claim 1, wherein said pad top end has a top width, said pad bottom end has a bottom width, and said middle section has a middle width, and wherein the middle width is greater than the top width and the bottom width.

8. The outboard boat motor protection device of claim 1, wherein the pad portion is generally rectangular and includes laterally extending flaps provided on the middle section.

9. The outboard boat motor protection device of claim 8, wherein said fastening devices are enclosed in said laterally extending flaps.

10. The outboard boat motor protection device of claim 1, wherein the insert comprises at least two layers of foam material including an inner layer positioned against the cowling back end and an outer layer positioned near the pad portion back side.

11. The outboard boat motor protection device of claim 10, wherein the inner layer is a softer material than the outer layer.

12. The outboard boat motor protection device of claim 1, wherein the combination of the one or more pad straps connected to the interior strap provides for encircling the inflexible insert and the cowling.

13. The outboard boat motor protection device of claim 1, wherein the top and bottom end widths are 6-17 inches, the middle section width is 10-25 inches, and the pad has a length of 20.5-27 inches.

14. The outboard boat motor protection device of claim 1, wherein said inflexible insert comprises at least two layers of foam material including an inner layer positioned against the cowling back end and an outer layer positioned near the pad back side, wherein the inner layer is a softer material than the outer layer, and wherein the inner layer is 4# Ether Charcoal foam sheet and the outer layer is 4# XL PE Black foam board.

15. A method of protecting a power head of an outboard boat motor from abrasion and/or damage, comprising the steps of:

a) providing a cowling that is removably connectable to the outboard boat motor and adapted to envelope the power head, said cowling having a front panel, a back panel, side panels, a top panel, and a lower edge;

b) providing a protective device on the cowling, the protective device including:

i) a pad portion including a sleeve and an inflexible insert sized and shaped to be encased in the sleeve, said pad portion having a top end, a bottom end, a middle section, a front side, and a back side;

ii) one or more pad straps removably attached to said pad middle section with a fastening device; and iii) an interior strap having end portions, said interior strap positioned inside the sleeve and in between the sleeve and the inflexible insert near the pad back side, wherein said interior strap extends across the pad middle portion and said end portions connect to the one or more pad strap via said fastening device;

c) securing the pad portion of the protective device to the cowling back panel by positioning said one or more pad straps along the cowling side panels and front panel and by attaching said one or more pad straps to the cowling side panels and front panel with one or more securing devices; and d) removably connecting the cowling with the protective device secured thereto to the power head to protect the power head;

wherein said pad portion is sized and shaped to cover a majority of the cowling back panel, and wherein said pad portion extends above and below said one or more pad straps; and wherein said one or more pad straps are positioned in between the cowling top panel and the cowling lower edge and extend around said cowling at the pad portion middle section.

16. The method of claim 15, wherein the pad portion middle section tapers to said top and bottom ends.

17. The method of claim 15, wherein the one or more securing device include suction devices.

18. The method of claim 15, wherein in step "c" the pad is immovable secured to the cowling.

19. A method of protecting a power head of an outboard boat motor from abrasion and/or damage, comprising the steps of:

a) connecting a protective device on a cowling that is removably connectable to the outboard boat motor and adapted to envelope the power head, said cowling having a front panel, a back panel, side panels, a top panel, and a lower edge, and wherein the protective device includes:

i) a pad portion including a sleeve and an inflexible insert sized and shaped to be encased in the sleeve, said pad portion having a top end, a bottom end, a middle section, a front side, and a back side;

ii) one or more pad straps removably attached to said pad middle section with a fastening device; and iii) an interior strap having end portions, said interior strap positioned inside the sleeve and in between the sleeve and the inflexible insert near the pad back side, wherein said interior strap extends across the pad middle section and said end portions connect to the one or more pad straps via said fastening device; and b) removably connecting the cowling with the protective device secured thereto on the outboard boat motor such that the cowling envelopes the power head and protects the power head.

20. The method of claim 19, wherein in step (a), the pad portion of the protective device is secured to the cowling back panel by:

i) positioning said one or more pad straps along the cowling side panels and front panel; and ii) attaching said one or more pad straps to the cowling side panels and front panel with one or more securing devices, wherein said one or more pad straps are positioned in between the cowling top panel and the cowling lower edge and extend around said cowling from the pad portion middle section; and wherein said pad portion is sized and shaped to cover a majority of the cowling back panel, and wherein said pad portion extends above and below said one or more pad straps.

* * * * *